US006514677B1

(12) United States Patent
Ramsden et al.

(10) Patent No.: US 6,514,677 B1
(45) **Date of Patent: *Feb. 4, 2003**

(54) THERMALLY DEVELOPABLE INFRARED SENSITIVE IMAGING MATERIALS CONTAINING HEAT-BLEACHABLE ANTIHALATION COMPOSITION

(75) Inventors: William D. Ramsden, Afton, MN (US); David G. Baird, Woodbury, MN (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/944,573

(22) Filed: Aug. 31, 2001

(51) Int. Cl.[7] ..... G03C 1/498; G03C 5/16; F21V 9/04

(52) U.S. Cl. ..... 430/350; 430/530; 430/513; 430/517; 430/522; 430/523; 430/577; 430/583; 430/584; 430/613; 430/619; 430/944; 252/587

(58) Field of Search ..... 430/350, 619, 430/944, 510, 523, 513, 522, 517, 600, 613, 964, 584, 583, 577; 252/587

(56) References Cited

U.S. PATENT DOCUMENTS 3,745,009 A 7/1973 Jenkins et al.
4,033,948 A 7/1977 Brown
4,196,002 A 4/1980 Levinson et al.
4,201,590 A 5/1980 Levinson et al.
4,283,487 A 8/1981 Lea et al.
4,581,323 A 4/1986 Fisher et al.
5,652,091 A 7/1997 Perry et al.
5,672,562 A 9/1997 Goswami et al.
5,705,323 A 1/1998 Perry et al.
6,297,001 B1 10/2001 Takiguchi et al.

*Primary Examiner*—Thorl Chea
*Assistant Examiner*— T
(74) *Attorney, Agent, or Firm*—J. Lanny Tucker; Louis M. Leichter

(57) ABSTRACT

Photothermographic materials comprise heat-bleachable antihalation compositions in antihalation layers. These compositions comprise a hexaarybiimidazole and one or more infrared radiation absorbing compounds that are represented by the following Structure I:

$$A_1—L_1—A_2 \qquad \text{I}$$

wherein $A_1$ represents a group derived from a dye base, a heterocyclic group, or an electron-donating aromatic group, $A_2$ represents a group derived from a dye base, a heterocyclic group, a group derived from a dye acid, or an electron-donating aromatic group, and $L_1$ represents a conjugated linking group that maintains electron delocalization between $A_1$ and $A_2$ to provide infrared absorbance. The antihalation composition is typically bleached when subjected to a temperature of at least 90° C. for at least 0.5 seconds.

32 Claims, No Drawings

THERMALLY DEVELOPABLE INFRARED SENSITIVE IMAGING MATERIALS CONTAINING HEAT-BLEACHABLE ANTIHALATION COMPOSITION

FIELD OF THE INVENTION

This invention relates to heat-bleachable antihalation compositions and their use in thermally developable infrared radiation sensitive imaging materials such as photothermographic materials. More particularly, it relates to photothermographic imaging materials that comprise an infrared radiation absorbing heat-bleachable antihalation composition, and have improved keeping stability. The invention also relates to methods of imaging using these materials. This invention is directed to the photothermographic imaging industry.

BACKGROUND OF THE INVENTION

Silver-containing photothermographic imaging materials that are developed with heat and without liquid development have been known in the art for many years. Such materials are used in a recording process wherein an image is formed by imagewise exposure of the photothermographic material to specific electromagnetic radiation (for example, visible, ultraviolet, or infrared radiation) and developed by the use of thermal energy. These materials, also known as "dry silver" materials, generally comprise a support having coated thereon: (a) a photosensitive catalyst (such as silver halide) that upon such exposure provides a latent image in exposed grains that are capable of acting as a catalyst for the subsequent formation of a silver image in a development step, (b) a non-photosensitive source of reducible silver ions, (c) a reducing composition (usually including a developer) for the reducible silver ions, and (d) a hydrophilic or hydrophobic binder. The latent image is then developed by application of thermal energy.

In such materials, the photosensitive catalyst is generally a photographic type photosensitive silver halide that is considered to be in catalytic proximity to the non-photosensitive source of reducible silver ions. Catalytic proximity requires intimate physical association of these two components either prior to or during the thermal image development process so that when silver atoms $(Ag^0)_n$, also known as silver specks, clusters, nuclei or latent image, are generated by irradiation or light exposure of the photosensitive silver halide, those silver atoms are able to catalyze the reduction of the reducible silver ions within a catalytic sphere of influence around the silver atoms [D. H. Klosterboer, in *Imaging Processes and Materials, (Neblette's Eighth Edition)*, J. Sturge, V. Walworth, and A. Shepp, Eds., Van Nostrand-Reinhold, New York, 1989, Chapter 9, pp. 279–291]. It has long been understood that silver atoms act as a catalyst for the reduction of silver ions, and that the photosensitive silver halide can be placed in catalytic proximity with the non-photosensitive source of reducible silver ions in a number of different ways (see, for example, *Research Disclosure,* June 1978, item 17029). Other photosensitive materials, such as titanium dioxide, cadmium sulfide, and zinc oxide have also been reported to be useful in place of silver halide as the photocatalyst in photothermographic materials [see for example, Shepard, *J. Appl. Photog. Eng.* 1982, 8(5), 210–212, Shigeo et al., *Nippon Kagaku Kaishi,* 1994, 11, 992–997, and FR 2,254, 047 (Robillard)].

The photosensitive silver halide may be made "in situ," for example by mixing an organic or inorganic halide-containing source with a source of reducible silver ions to achieve partial metathesis and thus causing the in situ formation of silver halide (AgX) grains throughout the silver source [see, for example, U.S. Pat. No. 3,457,075 (Morgan et al.)]. In addition, photosensitive silver halides and sources of reducible silver ions can be coprecipitated [see Usanov et al., *J. Imag. Sci. Tech.* 1996, 40, 104]. Alternatively, a portion of the reducible silver ions can be completely converted to silver halide, and that portion can be added back to the source of reducible silver ions (see Usanov et al., International Conference on Imaging Science, Sep. 7–11, 1998).

The silver halide may also be "preformed" and prepared by an "ex situ " process whereby the silver halide (AgX) grains are prepared and grown separately. With this technique, one has the possibility of controlling the grain size, grain size distribution, dopant levels, and composition much more precisely, so that one can impart more specific properties to both the silver halide grains and the photothermographic material. The preformed silver halide grains may be introduced prior to and be present during the formation of the source of reducible silver ions. Co-precipitation of the silver halide and the source of reducible silver ions provides a more intimate mixture of the two materials [see for example U.S. Pat. No. 3,839,049 (Simons)]. Alternatively, the preformed silver halide grains may be added to and physically mixed with the source of reducible silver ions.

The non-photosensitive source of reducible silver ions is a material that contains reducible silver ions. Typically, the preferred non-photosensitive source of reducible silver ions is a silver salt of a long chain aliphatic carboxylic acid having from 10 to 30 carbon atoms, or mixtures of such salts. Such acids are also known as "fatty acids" or "fatty carboxylic acids". Silver salts of other organic acids or other organic compounds, such as silver imidazoles, silver tetrazoles, silver benzotriazoles, silver benzotetrazoles, silver benzothiazoles and silver acetylides have also been proposed. U.S. Pat. No. 4,260,677 (Winslow et al.) discloses the use of complexes of various inorganic or organic silver salts.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer," may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. In photothermographic materials, upon heating, this reaction occurs preferentially in the regions surrounding the latent image. This reaction produces a negative image of metallic silver having a color that ranges from yellow to deep black depending upon the presence of toning agents and other components in the imaging layer(s).

Differences Between Photothermography and Photography

The imaging arts have long recognized that the field of photothermography is clearly distinct from that of photography. Photothermographic materials differ significantly from conventional silver halide photographic materials that require processing with aqueous processing solutions.

As noted above, in photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example a silver carboxylate) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. Even in so-called "instant photography," the developer chemistry is physically separated from the photosensitive silver halide until development is desired. The incorporation of the developer into photothermographic materials can lead to increased formation of various types of "fog" or other undesirable sensitometric side effects. Therefore, much effort has gone into the preparation and manufacture of photothermographic materials to minimize these problems during the preparation of the photothermographic emulsion as well as during coating, use, storage, and post-processing handling.

Moreover, in photothermographic materials, the unexposed silver halide generally remains intact after development and the material must be stabilized against further imaging and development. In contrast, silver halide is removed from conventional photographic materials after solution development to prevent further imaging (that is in the aqueous fixing step).

In photothermographic materials, the binder is capable of wide variation and a number of binders (both hydrophilic and hydrophobic) are useful. In contrast, conventional photographic materials are limited almost exclusively to hydrophilic colloidal binders such as gelatin.

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Imaging Processes and Materials* (*Neblette 's Eighth Edition*), noted above, *Unconventional Imaging Processes,* E. Brinckman et al. (Eds.), The Focal Press, London and New York, 1978, pp. 74–75, in Zou et al., *J. Imaging Sci. Technol.* 1996, 40, pp. 94–103, and in M. R. V. Sahyun, *J. Imaging Sci. Technol.* 1998, 42, 23.

Problem to be Solved

The photothermographic materials described above generally comprise one or more "antihalation" compounds or compositions that absorb reflected, transmitted or scattered infrared radiation so it does not cause unwanted exposure some distance laterally from the original point of exposure. Such unwanted exposure can render small image "halos" around imaged areas, reducing image sharpness. The antihalation compounds may also be known as "filter" dyes.

The most common use of antihalation compounds is in a layer on the backside of the support. Because many photothermographic materials are exposed at visible wavelengths, the antihalation compounds are necessarily colored. Thus, they must be rendered substantially transparent (for example, bleached or removed) during thermal development so they do not affect the appearance of the resulting image. A variety of dyes have been reported in the literature as useful as antihalation compounds in photothermographic materials. Such compounds generally include particular heat-bleachable dyes or incorporated addenda that can act as bleaching agents.

For example, the use of radicals from biimidazoles (specifically hexaarylbiimidazoles) in antihalation compositions is described in U.S. Pat. No. 4,196,002 (Levinson et al.) and U.S. Pat. No. 4,201,590 (Levinson et al.). The described compositions become colorless upon heat exposure for a given time. The compositions also include filter dyes that are used in reactive association with certain hexaarylbiimidazoles that contain alkyl substituents. The filter dyes are primarily formazan dyes.

Similar heat-bleachable compositions are described in U.S. Pat. No. 5,672,562 (Goswami et al.) and U.S. Pat. No. 5,705,323 (Perry et al.) in which specific hexaarylbiimidazoles (HABI's) are used in combination with formazan dyes to reduce the time and temperatures required for bleaching. Similar advantages are provided from the use of an acidic layer adjacent the antihalation layer, as described in U.S. Pat. No. 5,652,091 (Perry et al.).

Additional heat-bleachable antihalation compositions are described in copending and commonly assigned U.S. Ser. No. 09/875,772 (filed Jun. 6, 2001 by Goswarni, Ramsden, Zielinski, Baird, Weinstein, Helber, and Lynch). Such compositions include a HABI compound and an oxonol dye.

While the compounds described in the cited art are useful for their intended purpose, there is a continuing need to provide infrared radiation absorbing antihalation compositions that are bleached or changed in color when exposed to elevated temperature. Moreover, there is a need for infrared radiation absorbing antihalation compositions that are stable upon storage and exhibit faster and more complete and irreversible bleaching at lower temperatures during thermal development.

SUMMARY OF THE INVENTION

This invention provides a heat-bleachable antihalation composition comprising:

a) a hexaarylbiimidazole, and b) an infrared radiation-absorbing compound having the following Structure I:

$$A_1—L_1—A_2 \qquad \text{I}$$

wherein $A_1$ represents a group derived from a dye base, a heterocyclic group, or an electron-donating aromatic group, $A_2$ represents a group derived from a dye base, a heterocyclic group, a group derived from a dye acid, or an electron-donating aromatic group, and $L_1$ represents a conjugated linking group that maintains electron delocalization between $A_1$ and $A_2$ to provide infrared absorbance.

In a preferred embodiment, $L_1$ includes at least 3 carbon atoms with alternating carbon-carbon single and double bonds, and preferably at least 5 carbon atoms, some of which can be part of one or more unsaturated carbocyclic or heterocyclic rings. One or more substituents can be positioned along the conjugated chain.

In a preferred embodiment, $A_1$ and $A_2$ independently represent groups derived from dye bases and the infrared radiation-absorbing compound is represented by the following Structure II:

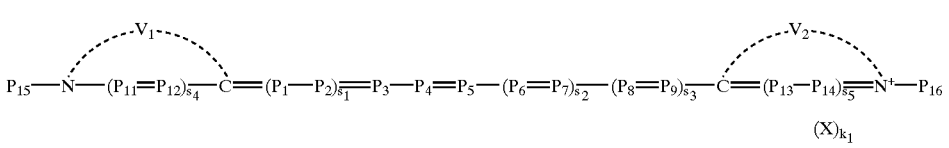

II wherein $V_1$ and V2 independently represent groups of atoms necessary to form substituted or unsubstituted 5-, 6-, or 7-membered heterocyclic rings, which rings may be further fused to additional carbocyclic or heterocyclic rings, $P_1$, $P_2$, $P_3$, $P_4$, $P_5$, $P_6$, $P_7$, $P_8$, $P_9$, $P_{10}$, $P_{11}$, $P_{12}$, $P_{13}$, and $P_{14}$, independently represent methine groups or substituted methine groups that optionally may form a ring with one or more other methine groups or with an auxochrome, $P_{15}$ and $P_{16}$ are independently alkyl, aryl, alkaryl, or heterocycl groups, $s_1$, $s_2$, $s_3$, $s_4$, and $s_5$ are independently equal to 0 or 1, X is an electric charge neutralizing counterion, and $k_1$ is an integer inclusive of 0 necessary to neutralize an electric charge in the molecule. Compounds represented by Structure II are commonly known as cyanine dyes.

In another preferred embodiment, $A_1$ and $A_2$ independently represent groups derived from heterocyclic groups, and the infrared radiation-absorbing compound is represented by the following Structure III:

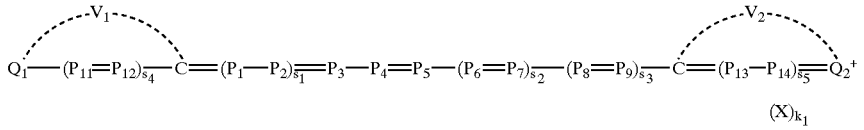

III wherein $Q_1$ and $Q_2$ independently represent heteroatoms (such as N, O, S, Se, or Te), and $V_1$, $V_2$, $P_1$, $P_2$, $P_3$, $P_4$, $P_5$, $P_6$, $P_7$, $P_8$, $P_9$, $P_{10}$, $P_{11}$, $P_{12}$, $P_{13}$, $P_{14}$, $s_1$, $s_2$, $s_3$, $s_4$, $s_5$, X, and $k_1$ are as described above.

In still another preferred embodiment, $A_1$ represents a group derived from a dye base and $A_2$ represents a group derived from a dye acid, and the infrared radiation-absorbing compound is represented by the following Structure IV:

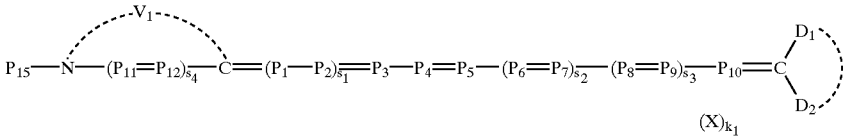

IV wherein $P_{10}$ represents a methine group or a substituted methine group that may form a ring with one or more other methine groups or a ring with an auxochrome, $D_1$ and $D_2$ independently represent the atoms necessary to form acidic acyclic, carbocyclic, or heterocyclic nuclei, and $V_1$, $P_1$, $P_2$, $P_3$, $P_4$, $P_5$, $P_6$, $P_7$, $P_8$, $P_9$, $P_{11}$, $P_{12}$, $P_{15}$, $s_1$, $s_2$, $s_3$, $s_4$, X, and $k_1$ are as described above. Compounds represented by Structure IV are commonly known as merocyanine dyes.

In another preferred embodiment, $A_1$ and $A_2$ independently represent groups derived from an electron-donating aromatic group, and the infrared radiation-absorbing compound is represented by the following Structure V:

V $$(W_1)_a—Ar_1^+=(P_1—P_2)_{s_1}=P_3—P_4=P_5—(P_6=P_7)_{s_2}—(P_8=P_9)_{s_3}—Ar_2—(W_2)_b$$

$$(X)_{k_1}$$

wherein $Ar_1$ and $Ar_2$ independently represent aromatic groups, $W_1$ and $W_2$ independently represent electron-donating substituent groups, "a" and "b" independently represent integers from 0 to 5, and $P_1$, $P_2$, $P_3$, $P_4$, $P_5$, $P_6$, $P_7$, $P_8$, $P_9$, $s_1$, $s_2$, $s_3$ X, and $k_1$ are as described above.

In another preferred embodiment, $A_1$ represents a group derived from a dye base, and $A_2$ represents an electron-donating aromatic group, and the infrared radiation-absorbing compound is represented by the following Structure VI:

VI $$P_{15}—N(V_1)—(P_{11}=P_{12})_{s_4}—C=(P_1—P_2)_{s_1}=P_3—P_4=P_5—(P_6=P_7)_{s_2}—(P_8=P_9)_{s_3}—P_{10}=Ar_2^+—(W_2)_b$$

$$(X)_{k_1}$$

wherein $V_1$, $P_1$, $P_2$, $P_3$, $P_4$, $P_5$, $P_6$, $P_7$, $P_8$, $P_9$, $P_{10}$, $P_{11}$, $P_{12}$, $P_{15}$, $s_1$, $s_2$, $s_3$, $s_4$, $Ar_2$, $W_2$, "b", X, and $k_1$ are as described above.

In yet another preferred embodiment, $A_1$ represents a group derived from a dye base, and $A_2$ represents a heterocyclic group, and the infrared radiation-absorbing compound is represented by the following Structure VII:

VII $$P_{15}—N(V_1)—(P_{11}=P_{12})_{s_4}—C=(P_1—P_2)_{s_1}=P_3—P_4=P_5—(P_6=P_7)_{s_2}—(P_8=P_9)_{s_3}—C(V_2)=(P_{13}—P_{14})_{s_5}=Q_2^+$$

$$(X)_{k_1}$$

wherein $V_1$, $V_2$, $P_1$, $P_2$, $P_3$, $P_4$, $P_5$, $P_6$, $P_7$, $P_8$, $P_9$, $P_{10}$, $P_{11}$, $P_{12}$, $P_{13}$, $P_{14}$, $P_{15}$, $s_1$, $s_2$, $s_3$, $s_4$, $s_5$, $Q_2$, X, and $k_1$ are as described above.

In another preferred embodiment, $A_1$ represents a group derived from an electron-donating aromatic group, and $A_2$ represents a group derived from a dye acid, and the infrared radiation-absorbing compound is represented by the following Structure VIII:

VIII $$C(D_1)(D_2)=(P_1—P_2)_{s_1}=P_3—P_4=P_5—(P_6=P_7)_{s_2}—(P_8=P_9)_{s_3}—Ar_1—(W_1)_a$$

wherein $D_1$, $D_2$, $P_1$, $P_2$, $P_3$, $P_4$, $P_5$, $P_6$, $P_7$, $P_8$, $P_9$, $s_1$, $s_2$, $s_3$, $Ar_1$, $W_1$, and "a" are us described above.

In still another preferred embodiment, $A_1$ represents a group derived from a heterocyclic group, and $A_2$ represents a group derived from a dye acid, and the infrared radiation-absorbing compound is represented by the following Structure IX:

IX

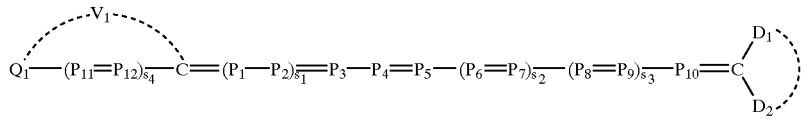

wherein $D_1$, $D_2$, $P_1$, $P_2$, $P_3$, $P_4$, $P_5$, $P_6$, $P_7$, $P_8$, $P_9$, $P_{10}$, $P_{11}$, $P_{12}$, $s_1$, $s_2$, $s_3$, $s_4$, $Q_1$, and $V_1$ are as described above.

In another preferred embodiment, $A_1$ represents a group derived from a heterocyclic group, and $A_2$ represents a group derived from an electron-donating aromatic group, and the infrared radiation-absorbing compound is represented by the following Structure X:

X

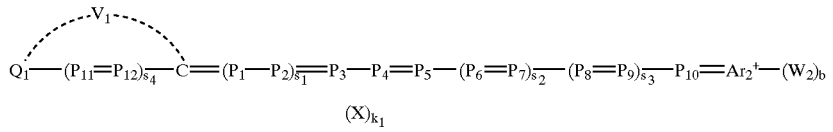

wherein $V_1$, $P_1$, $P_2$, $P_3$, $P_4$, $P_5$, $P_6$, $P_7$, $P_8$, $P_9$, $P_{10}$, $P_{11}$, $P_{12}$, $s_1$, $s_2$, $s_3$, $s_4$, $Ar_2$, $W_2$, "b", X and $k_1$ are as described above.

This invention also provides a photothermographic material that is sensitive at a wavelength of at least 700 nm and comprises a support having thereon one or more thermally-developable imaging layers comprising a hydrophobic binder and in reactive association, a photocatalyst (such as a photosensitive silver halide), a non-photosensitive source of reducible silver ions, and a reducing composition for the non-photosensitive source of reducible silver ions, and an infrared radiation-absorbing antihalation layer (preferably on the backside of the support) comprising the heat-bleachable antihalation composition described above.

Further, this invention provides a method of forming a visible image comprising:

A) imagewise exposing the photothermographic material described above to electromagnetic radiation at a wavelength of at least 700 nm to form a latent image, and B) simultaneously or sequentially, heating the exposed photothermographic material to develop the latent image into a visible image.

When the photothermographic materials of this invention are heat-developed as described below in a substantially water-free condition after, or simultaneously with, imagewise exposure, a silver image (preferably a black-and-white silver image) is obtained. The photothermographic material may be exposed in step A using any source of infrared radiation, including: an infrared laser, an infrared laser diode, an infrared light-emitting diode, an infrared lamp, or any other infrared radiation source readily apparent to one skilled in the art.

In some embodiments, wherein the photothermographic material comprises a transparent support, the image-forming method further comprises:

C) positioning the exposed and heat-developed photothermographic material between a source of imaging radiation and an imageable material that is sensitive to the imaging radiation, and D) exposing the imageable material to the imaging radiation through the visible image in the exposed and heat-developed photothermographic material to provide an image in the imageable material.

The present invention provides a number of advantages with the novel heat-bleachable infrared radiation-absorbing antihalation composition described herein. The infrared radiation-absorbing compounds used in the composition, combined with the hexaarylbiimidazoles, provide high initial infrared radiation absorbance, and after thermal development, a low level of residual coloration, a shift in hue, and a low absorption of radiation in the range of 360 to 400 nm.

DETAILED DESCRIPTION OF THE INVENTION

The photothermographic materials of this invention can be used, for example, in conventional black-and-white or color photothermography and in electronically generated black-and-white or color hardcopy recording. They can be used in microfilm applications, in radiographic imaging (for example digital medical imaging), and industrial radiography. Furthermore, the absorbance of these photothermographic materials between 350 and 450 nm is desirably low (less than 0.5), to permit their use in the graphic arts area (for example, image-setting and phototypesetting), in the manufacture of printing plates, in contact printing, in duplicating ("duping"), and in proofing. The photothermographic materials of this invention are particularly useful for medical radiography to provide black-and-white images.

The photothermographic materials of this invention are sensitive to radiation at a wavelength of at least 700 nm, and preferably at a wavelength of from about 750 nm to about 1400 nm.

In the photothermographic materials of this invention, the components needed for imaging can be in one or more layers. The layer(s) that contain the photosensitive photocatalyst (such as a photosensitive silver halide) or non-photosensitive source of reducible silver ions, or both, are referred to herein as photothermographic emulsion layer(s). The photocatalyst and the non-photosensitive source of reducible silver ions are in catalytic proximity (that is, in reactive association with each other) and preferably are in the same emulsion layer. "Catalytic proximity" or "reactive association" means that they are in the same layer or in adjacent layers.

Various layers are usually disposed on the "backside" (non-emulsion side) of the materials, including antihalation layer(s), protective layers, antistatic layers, conducting layers, and transport enabling layers.

Various layers are also usually disposed on the "frontside" or emulsion side of the support, including protective topcoat layers, primer layers, interlayers, opacifying layers, antistatic layers, antihalation layers, acutance layers, auxiliary layers, and others readily apparent to one skilled in the art.

Definitions

As used herein:

In the descriptions of the photothermographic materials of the present invention, "a" or "an" component refers to "at least one" of that component. For example, the HABI compounds and infrared absorbing compounds described herein for heat-bleaching can be used individually or in combinations.

HABI means hexaarylbiimidazole compound.

PECHS- is perfluoro(ethylcyclohexane)sulfonate1-$C_2F_5$—$C_6F_{10}$—$SO_3^-$

"Alkylcarboxy" means -alkyl-COOH or -alkyl-$COO^-$.

"Carboxyalkyl" means -COO-alkyl.

"Carboxamido" means -CON-alkyl, aryl, or hydrogen)$_2$.

The term "heat-bleachable" as used in reference to the antihalation compositions of this invention refers to antihalation compositions which, when heated, exhibit a decrease in infrared absorption of at least 50%. Additionally, the level of visible absorption generally decreases, and may also shift in hue. The change in visible absorption and hue may be conveniently monitored using the L a* b* color system as further described below.

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process,* Fourth Edition, 1977, p. 374.

"Photothermographic material(s)" means a construction comprising at least one photothermographic emulsion layer or a photothermographic set of layers (wherein the silver halide and the source of reducible silver ions are in one layer and the other essential components or desirable additives are distributed, as desired, in an adjacent coating layer) and any supports, topcoat layers, image-receiving layers, blocking layers, antihalation layers, subbing or priming layers. These materials also include multilayer constructions in which one or more imaging components are in different layers, but are in "reactive association" so that they readily come into contact with each other during imaging and/or development. For example, one layer can include the non-photosensitive source of reducible silver ions and another layer can include the reducing composition, but the two reactive components are in reactive association with each other.

"Emulsion layer", "imaging layer", or "photothermographic emulsion layer" means a layer of a photothermographic material that contains the photosensitive silver halide and/or non-photosensitive source of reducible silver ions. It can also mean a layer of the photothermographic material that contains, in addition to the photosensitive silver halide and/or non-photosensitive source of reducible ions, additional essential components and/or desirable additives. These layers are usually on what is known as the "frontside" of the support.

"Ultraviolet region of the spectrum" refers to that region of the spectrum less than or equal to 410 nm, and preferably from about 100 nm to about 410 nm, although parts of these ranges may be visible to the naked human eye. More preferably, the ultraviolet region of the spectrum is the region of from about 190 to about 405 nm.

"Visible region of the spectrum" refers to that region of the spectrum of from about 400 nm to about 700 nm.

"Short wavelength visible region of the spectrum" refers to that region of the spectrum of from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

An auxochrome is a group of atoms that when conjugated to a chromophore intensifies and/or shifts the color of that chromophore.

"Non-photosensitive" means not intentionally light sensitive.

The sensitometric terms "photospeed" or "photographic speed", absorbance, $D_{min}$, and $D_{max}$ have conventional definitions known in the imaging arts.

"Transparent" means capable of transmitting visible light or imaging radiation without appreciable scattering or absorption.

"Dye base" means a compound derived from a quaternized heterocyclic ammonium salt and containing an electrophilically-reactive olefinic methylene or methine group conjugatively located to the nitrogen atom of the ammonium salt. Basic nuclei are discussed in C. E. K. Mees and T. H. James, *The Theory of the Photographic Process,* Fourth Edition, 1977, pp. 198–200.

"Dye acid" means a compound having an active methylehe group and having an electron withdrawing chromophore. Acidic nuclei are defined in C. E. K. Mees and T. H. James, *The Theory of the Photographic Process,* Fourth Edition, 1977, pp. 198–200.

"Electron-donating" means a group that contributes to the electron density of a π-electron system.

"Electron-withdrawing" means a group that attracts electron density from a π-electron system.

The electron-donating and electron withdrawing nature of a chemical group may be determined by a variety of methods. The Hammett sigma value (σ) is an accepted measure of a group's electron-donating and withdrawing ability, especially the sigma para value ($\sigma_p$). See, for example, O. Exner in *Advances in Linear-Free-Energy* Relationships, Chapman, N. B. and Shorter, J., Eds., Plenum, N.Y., 1972, pp. 28–30, 41–45, and 50–52.

In the compounds described herein, no particular double bond geometry (for example, cis or trans) is intended by the structure of Formulas I to X or any of the other formulae shown herein. Similarly, the alternating single and double bonds and localized charges are drawn as a formalism. In reality, both electron and charge delocalization exist throughout the conjugated chain.

As is well understood in this art, for the hexaarylbiimidazole and infrared radiation-absorbing compounds herein described, substitution is not only tolerated, but is often advisable and various substituents are anticipated on the compounds used in the present invention. Thus, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl"). For example, where a benzene ring structure is shown (including fused ring structures), substituent groups may be placed on the benzene ring structure, but the atoms making up the benzene ring structure may not be replaced.

As a means of simplifying the discussion and recitation of certain substituent groups, the term "group" refers to chemical species that may be substituted as well as those that are not so substituted. Thus, the term "group," such as "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group includes ether and thioether groups (for example $CH_3$—$CH_2$—$H_2$—O—$CH_2$— and $CH_3$—$CH_2$—$CH_2$—S—$CH_2$—), haloalkyl, nitroalkyl, alkylcarboxy, carboxyalkyl, carboxamido, hydroxyalkyl, sulfoalkyl, and other groups readily apparent to one skilled in the art. Substituents that adversely react with other active ingredients, such as very strongly electrophilic or oxidizing substituents, would, of course, be excluded by the ordinarily skilled artisan as not being inert or harmless.

*Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y. 10011).

Other aspects, advantages, and benefits of the present invention are apparent from the detailed description, examples, and claims provided in this application.

The Photocatalyst

As noted above, the photothermographic materials of the present invention include one or more photocatalysts in the photothermographic emulsion layer(s). Useful photocatalysts are typically silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. Silver bromide and silver bromoiodide are more preferred, with the latter silver halide having up to 10 mol % silver iodide. Typical techniques for preparing and precipitating silver halide grains are described in *Research Disclosure,* 1978, Item 17643.

The shape of the photosensitive silver halide grains used in the present invention is in no way limited. The silver halide grains may have any crystalline habit including, but not limited to, cubic, octahedral, tetrahedral, orthorhombic, rhombic, dodecahedral, other polyhedral, tabular, laminar, twinned, or platelet morphologies and may have epitaxial growth of crystals thereon. If desired, a mixture of these crystals can be employed. Silver halide grains having cubic and tabular morphology are preferred.

The silver halide grains may have a uniform ratio of halide throughout. They may have a graded halide content, with a continuously varying ratio of, for example, silver bromide and silver iodide or they may be of the core-shell type, having a discrete core of one halide ratio, and a discrete shell of another halide ratio. Core-shell silver halide grains useful in photothermographic materials and methods of preparing these materials are described for example in U.S. Pat. No. 5,382,504 (Shor et al.), incorporated herein by reference. Iridium and/or copper doped core-shell and non-core-shell grains are described in U.S. Pat. No. 5,434,043 (Zou et al.) and U.S. Pat. No. 5,939,249 (Zou), both incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halides be preformed and prepared by an ex-situ process. The silver halide grains prepared ex-situ may then be added to and physically mixed with the non-photosensitive source of reducible silver ions. It is more preferable to form the source of reducible silver ions in the presence of ex-situ-prepared silver halide. In this process, the source of reducible silver ions, such as a long chain fatty acid silver carboxylate (commonly referred to as a silver "soap"), is formed in the presence of the preformed silver halide grains. Co-precipitation of the reducible source of silver ions in the presence of silver halide provides a more intimate mixture of the two materials [see, for example U.S. Pat. No. 3,839,049 (Simons)]. Materials of this type are often referred to as "preformed soaps".

The silver halide grains used in the imaging formulations can vary in average diameter of up to several micrometers (am) depending on their desired use. Preferred silver halide grains are those having an average particle size of from about 0.01 to about 1.5 $\mu$m, more preferred are those having an average particle size of from about 0.03 to about 1.0 $\mu$m, and most preferred are those having an average particle size of from about 0.05 to about 0.8 $\mu$m. Those of ordinary skill in the art understand that there is a finite lower practical limit for silver halide grains that is partially dependent upon the wavelengths to which the grains are spectrally sensitized. Such a lower limit, for example, is typically from about 0.01 to about 0.005 $\mu$m.

The average size of the photosensitive doped silver halide grains is expressed by the average diameter if the grains are spherical, and by the average of the diameters of equivalent circles for the projected images if the grains are cubic or in other non-spherical shapes.

Grain size may be determined by any of the methods commonly employed in the art for particle size measurement. Representative methods are described by in "Particle Size Analysis," ASTM Symposium on Light Microscopy, R. P. Loveland, 1955, pp. 94–122, and in C. E. K. Mees and T. H. James, *The Theory of the Photographic Process,* Third Edition, Macmillan, New York, 1966, Chapter 2. Particle size measurements may be expressed in terms of the projected areas of grains or approximations of their diameters. These will provide reasonably accurate results if the grains of interest are substantially uniform in shape.

Preformed silver halide emulsions used in the material of this invention can be prepared by aqueous or organic processes and can be unwashed or washed to remove soluble salts. In the latter case, the soluble salts can be removed by ultrafiltration, by chill setting and leaching, or by washing the coagulum [for example, by the procedures described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.), and U.S. Pat. No. 2,489,341 (Waller et al.)].

It is also effective to use an in situ process in which a halide-containing compound is added to an organic silver salt to partially convert the silver of the organic silver salt to silver halide. The halogen-containing compound can be inorganic (such as zinc bromide or lithium bromide) or organic (such as N-bromosuccinimide).

Additional methods of preparing these silver halide and organic silver salts and manners of blending them are described in *Research Disclosure*, June 1978, item 17029, U.S. Pat. No. 3,700,458 (Lindholm) and U.S. Pat. No.

4,076,539 (Ikenoue et al.), and JP Applications 13224/74, 42529/76, and 17216/75.

In some instances, it may be helpful to prepare the photosensitive silver halide grains in the presence of a hydroxytetrazindene (such as 4-hydroxy-6-methyl-1,3,3,3a, 7-tetrazaindene) or an N-heterocyclic compound comprising at least one mercapto group (such as 1-phenyl-5-mercaptotetrazole) to provide increased photospeed. Details of this procedure are provided in U.S. Pat. No. 6,413,710 (Shore et al.), that is incorporated herein by reference.

The one or more light-sensitive silver halides used in the photothermographic materials of the present invention are preferably present in an amount of from about 0.005 to about 0.5 mole, more preferably from about 0.01 to about 0.25 mole, and most preferably from about 0.03 to about 0.15 mole, per mole of non-photosensitive source of reducible silver ions.

Chemical and Spectral Sensitizers

The photosensitive silver halides used in the invention may be may be employed without modification. However, one or more conventional chemical sensitizers may be used in the preparation of the photosensitive silver halides to increase photospeed. Such compounds may contain sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process,* Fourth Edition, 1977, Chapter 5, pp. 149–169. Suitable conventional chemical sensitization procedures are also described in U.S. Pat. No. 1,623,499 (Sheppard et al.), U.S. Pat. No. 2,399,083 (Waller et al.), U.S. Pat. No. 3,297,447 (McVeigh), U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), and EP-A-0 915,371 (Lok et al.).

In one embodiment, chemical sensitization is achieved by oxidative decomposition of a spectral sensitizing dye in the presence of a photothermographic emulsion. Such sensitization is described in U.S. Pat. No. 5,891,615 (Winslow et al.), incorporated herein by reference.

In another embodiment, certain substituted and unsubstituted thiourea compounds can be used as chemical sensitizers. Particularly useful tetra-substituted thioureas are described in U.S. Pat. No. 6,368,779 (Lynch et al.),that is incorporated herein by reference.

Still other useful chemical sensitizers include certain tellurium-containing compounds that are described in copending and commonly assigned U.S. Ser. No. 09/746,400 (filed Dec. 21, 2000 by Lynch, Opatz, Shor, Simpson, Willett, and Gysling), that is incorporated herein by reference.

Combinations of gold(III)-containing compounds and either sulfur- or tellurium-containing compounds are useful as chemical sensitizers as described in U.S. Pat. No. 6,423,481 (Simpson et al.), that is also incorporated herein by reference.

The chemical sensitizers can be used in making the silver halide emulsions in conventional amounts that generally depend upon the average size of the silver halide grains. Generally, the total amount is at least $10^{-10}$ mole per mole of total silver, and preferably from about $10^{-8}$ to about $10^{-2}$ mole per mole of total silver for silver halide grains having an average size of from about 0.01 to about 2 $\mu$m. The upper limit can vary depending upon the compound(s) used, the level of silver halide and the average grain size, and would be readily determinable by one of ordinary skill in the art.

In general, it may also be desirable to add spectral sensitizing dyes to enhance silver halide sensitivity to infrared light. Thus, the photosensitive silver halides may be spectrally sensitized with various dyes that are known to spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. The cyanine dyes preferably include benzothiazole, benzoxazole, and benzoselenazole dyes that include one or more thioalkyl, thioaryl, or thioether groups. The cyanine dyes, merocyanine dyes and complex merocyanine dyes are particularly useful. Suitable sensitizing dyes such as those described in U.S. Pat. No. 3,719,495 (Lea), U.S. Pat. No. 5,393,654 (Burrows et al.), U.S. Pat. No. 5,441,866 (Miller et al.) and U.S. Pat. No. 5,541,054 (Miller et al.), U.S. Pat. No. 5,281,515 (Delprato et al.), and U.S. Pat. No. 5,314,795 (Helland et al.) are effective in the practice of the invention. All of the patents above are incorporated herein by reference.

An appropriate amount of spectral sensitizing dye added is generally about $10^{-10}$ to $10^{-1}$ mole, and preferably, about $10^{-7}$ to $10^{-2}$ mole per mole of silver halide.

Non-Photosensitive Source of Reducible Silver Ions

The non-photosensitive source of reducible silver ions used in photothermographic materials of this invention can be any compound that contains reducible silver (1+) ions. Preferably, it is a silver salt that is comparatively stable to light and forms a silver image when heated to 50° C. or higher in the presence of an exposed photocatalyst (such as silver halide) and a reducing composition.

Silver salts of organic acids, particularly silver salts of long-chain carboxylic acids are preferred. The chains typically contain 10 to 30, and preferably 15 to 28, carbon atoms. Suitable organic silver salts include silver salts of organic compounds having a carboxylic acid group. Examples thereof include a silver salt of an aliphatic carboxylic acid or a silver salt of an aromatic carboxylic acid. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof Preferably, at least silver behenate is used alone or in mixtures with other silver salts.

Preferred examples of the silver salts of aromatic carboxylic acid and other carboxylic acid group-containing compounds include, but are not limited to, silver benzoates, a silver substituted-benzoate, such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, silver tannate, silver phthalate, silver terephthalate, silver salicylate, silver phenylacetate, silver pyromellitate, a silver salt of 3-carboxymethyl-4-methyl-4-thiazoline-2-thione or others as described in U.S. Pat. No. 3,785,830 (Sullivan et al.), and silver salts of aliphatic carboxylic acids containing a thioether group as described in U.S. Pat. No. 3,330,663 (Weyde et al.). Soluble silver carboxylates comprising hydrocarbon chains incorporating ether or thioether linkages, or sterically hindered substitution in the $\alpha$-(on a hydrocarbon group) or ortho-(on an aromatic group) position, and displaying increased solubility in coating solvents and affording coatings with less light scattering can also be used. Such silver carboxylates are described in U.S. Pat. No. 5,491,059 (Whitcomb). Mixtures of any of the silver salts described herein can also be used if desired.

Silver salts of sulfonates are also useful in the practice of this invention. Such materials are described for example in U.S. Pat. No. 4,504,575 (Lee). Silver salts of sulfosuccinates are also useful as described for example in EP-A-0 227 141 (Leenders et al.).

Silver salts of compounds containing mercapto or thione groups and derivatives thereof can also be used. Preferred examples of these compounds include, but are not limited to, a silver salt of 3-mercapto-4-phenyl-1,2,4-triazole, a silver salt of 2-mercaptobenzimidazole, a silver salt of 2-mercapto-5-amino-thiadiazole, a silver salt of 2-(2-ethylglycolamido)benzothiazole, silver salts of thioglycolic acids (such as a silver salt of a S-alkylthioglycolic acid, wherein the alkyl group has from 12 to 22 carbon atoms), silver salts of dithiocarboxylic acids (such as a silver salt of dithioacetic acid), a silver salt of thioamide, a silver salt of 5-carboxylic-1-methyl-2-phenyl-4-thiopyridine, a silver salt of mercaptotriazine, a silver salt of 2-mercaptobenzoxazole, silver salts as described in U.S. Pat. No. 4,123,274 (Knight et al.) (for example, a silver salt of a 1,2,4-mercaptothiazole derivative, such as a silver salt of 3-amino-5-benzylthio-1,2,4-thiazole), and a silver salt of thione compounds [such as a silver salt of 3-(2-carboxyethyl)-4-methyl-4-thiazoline-2-thione as described in U.S. Pat. No. 3,201,678 (Meixell)].

Furthermore, a silver salt of a compound containing an imino group can be used. Preferred examples of these compounds include, but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Moreover, silver salts of acetylenes can also be used as described, for example in U.S. Pat. No. 4,761,361 (Ozaki et al.) and U.S. Pat. No. 4,775,613 (Hirai et al.).

It is also convenient to use silver half soaps. A preferred example of a silver half soap is an equimolar blend of silver carboxylate and carboxylic acid, which analyzes for about 14.5% by weight solids of silver in the blend and which is prepared by precipitation from an aqueous solution of the sodium salt of a commercial fatty carboxylic acid, or by addition of the free fatty acid to the silver soap. For transparent films a silver carboxylate full soap, containing not more than about 15% of free fatty carboxylic acid and analyzing for about 22% silver, can be used. For opaque photothermographic materials, different amounts can be used.

The methods used for making silver soap emulsions are well known in the art and are disclosed in *Research Disclosure,* April 1983, item 22812, *Research Disclosure,* October 1983, item 23419, U.S. Pat. No. 3,985,565 (Gabrielsen et al.) and the references cited above.

Non-photosensitive sources of reducible silver ions can also be provided as core-shell silver salts such as those described in U.S. Pat. No. 6,355,408 (Whitcomb et al.), that is incorporated herein by reference. These silver salts include a core comprised of one or more silver salts and a shell having one or more different silver salts.

Still another useful source of non-photosensitive reducible silver ions in the practice of this invention are the silver dimer compounds that comprise two different silver salts as described in copending U.S. Ser. No. 09/812,597 (filed Mar. 20, 2001 by Whitcomb), that is incorporated herein by reference. Such non-photosensitive silver dimer compounds comprise two different silver salts, provided that when the two different silver salts comprise straight-chain, saturated hydrocarbon groups as the silver coordinating ligands, those ligands differ by at least 6 carbon atoms.

As one skilled in the are would understand, the non-photosensitive source of reducible silver ions can include various mixtures of the various silver salt compounds described herein, in any desirable proportions.

The photocatalyst and the non-photosensitive source of reducible silver ions must be in catalytic proximity (that is, reactive association). It is preferred that these reactive components be present in the same emulsion layer.

The one or more non-photosensitive sources of reducible silver ions are preferably present in an amount of about 5% by weight to about 70% by weight, and more preferably, about 10% to about 50% by weight, based on the total dry weight of the emulsion layers. Stated another way, the amount of the sources of reducible silver ions is generally present in an amount of from about 0.001 to about 0.2 $mol/m^2$ of the dry photothermographic material, and preferably from about 0.01 to about 0.05 $mol/m^2$ of that material.

The total amount of silver (from all silver sources) in the photothermographic materials is generally at least 0.002 $mol/m^2$ and preferably from about 0.01 to about 0.05 $mol/m^2$.

Reducing Agents

The reducing agent (or reducing agent composition comprising two or more components) for the source of reducible silver ions can be any material, preferably an organic material, that can reduce silver (I) ion to metallic silver. Conventional photographic developers such as methyl gallate, hydroquinone, substituted hydroquinones, hindered phenols, amidoximes, azines, catechol, pyrogallol, ascorbic acid (and derivatives thereof), leuco dyes and other materials readily apparent to one skilled in the art can be used in this manner as described for example in U.S. Pat. No. 6,020,117 (Bauer et al.).

In some instances, the reducing agent composition comprises two or more components such as a hindered phenol developer and a co-developer that can be chosen from the various classes of reducing agents described below. Ternary developer mixtures involving the further addition of contrast enhancing agents are also useful. Such contrast enhancing agents can be chosen from the various classes of reducing agents described below.

Hindered phenol reducing agents are preferred (alone or in combination with one or more high-contrast co-developing agents and co-developer contrast enhancing agents). These are compounds that contain only one hydroxy group on a given phenyl ring and have at least one additional substituent located ortho to the hydroxy group. Hindered phenol developers may contain more than one hydroxy group as long as each hydroxy group is located on different phenyl rings. Hindered phenol developers include, for example, binaphthols (that is dihydroxybinaphthyls), biphenols (that is dihydroxybiphenyls), bis(hydroxynaphthyl) methanes, bis(hydroxyphenyl)methanes, hindered phenols, and hindered naphthols, each of which may be variously substituted.

Representative binaphthols include, but are not limited, to 1,1'-bi-2-naphthol, 1,1'-bi-4-methyl-2-naphthol and 6,6'-dibromo-bi-2-naphthol. For additional compounds see U.S. Pat. No. 3,094,417 (Workman) and U.S. Pat. No. 5,262,295 (Tanaka et al.), both incorporated herein by reference.

Representative biphenols include, but are not limited, to 2,2'-dihydroxy-3,3'-di-t-butyl-5,5-dimethylbiphenyl, 2,2'-dihydroxy-3,31',5,5'-tetra-t-butylbiphenyl, 2,2'-dihydroxy-3,3'-di-t-butyl-5,5'-dichlorobiphenyl, 2-(2-hydroxy-3-t-butyl-5-methylphenyl)-4-methyl-6-n-hexylphenol, 4,4'-dihydroxy-3,3',5,5'-tetra-t-butylbiphenyl and 4,4'-dihydroxy-3,3',5,5'-tetramethylbiphenyl. For additional compounds see U.S. Pat. No. 5,262,295 (noted above).

Representative bis(hydroxynaphthyl)methanes include, but are not limited to, 4,4'-methylenebis(2-methyl-1-naphthol). For additional compounds see U.S. Pat. No. 5,262,295 (noted above).

Representative bis(hydroxyphenyl)methanes include, but are not limited to, bis(2-hydroxy-3-t-butyl-5-methylphenyl) methane (CAO-5), 1,1'-bis(2-hydroxy-3,5-dimethylphenyl)-3,5,5-trimethylhexane (NONOX or PERMANAX WSO), 1,1'-bis(3,5-di-t-butyl-4-hydroxyphenyl)methane, 2,2'-bis (4-hydroxy-3-methylphenyl)propane, 4,4'-ethylidene-bis(2-t-butyl-6-methylphenol), 2,2'-isobutylidene-bis(4,6-dimethylphenol) (LOWINOX 221B46), and 2,2'-bis(3,5-dimethyl-4-hydroxyphenyl)propane. For additional compounds see U.S. Pat. No. 5,262,295 (noted above).

Representative hindered phenols include, but are not limited to, 2,6-di-t-butylphenol, 2,6-di-t-butyl-4-methylphenol, 2,4-di-t-butylphenol, 2,6-dichlorophenol, 2,6-dimethylphenol and 2-t-butyl-6-methylphenol.

Representative hindered naphthols include, but are not limited to, 1-naphthol, 4-methyl-1-naphthol, 4-methoxy-1-naphthol, 4-chloro-1-naphthol and 2-methyl-1-naphthol. For additional compounds see U.S. Pat. No. 5,262,295 (noted above).

More specific alternative reducing agents that have been disclosed in dry silver systems including amidoximes such as phenylamidoxime, 2-thienylamidoxime and p-phenoxyphenylamidoxime, azines (for example, 4-hydroxy-3,5-dimethoxybenzaldehydrazine), a combination of aliphatic carboxylic acid aryl hydrazides and ascorbic acid, such as 2,2'-bis(hydroxymethyl)-propionyl-β-phenyl hydrazide in combination with ascorbic acid, a combination of polyhydroxybenzene and hydroxylamine, a reductone and/or a hydrazine [for example, a combination of hydroquinone and bis(ethoxyethyl)hydroxylamine], piperidino-hexose reductone or formyl-4-methylphenylhydrazine, hydroxamic acids (such as phenylhydroxamic acid, p-hydroxyphenylhydroxamic acid, and o-alaninehydroxamic acid), a combination of azines and sulfonamidophenols (for example, phenothiazine and 2,6-dichloro-4-benzenesulfonamidophenol), α-cyanophenylacetic acid derivatives (such as ethyl α-cyano-2-methylphenylacetate and ethyl α-cyanophenylacetate), bis-o-naphthols [such as 2,2'-dihydroxyl-1-binaphthyl, 6,6'-dibromo-2,2'-dihydroxy-1,1'-binaphthyl, and bis(2-hydroxy-1-naphthyl)methane], a combination of bis-o-naphthol and a 1,3-dihydroxybenzene derivative (for example, 2,4-dihydroxybenzophenone or 2,4-dihydroxyacetophenone), 5-pyrazolones such as 3-methyl-1-phenyl-5-pyrazolone, reductones (such as dimethylaminohexose reductone, anhydrodihydroaminohexose reductone and anhydrodihydro-piperidone-hexose reductone), sulfonamidophenol reducing agents (such as 2,6-dichloro-4-benzenesulfonamidophenol, and p-benzenesulfonamidophenol), 2-phenylindane-1,3-dione and similar compounds, chromans (such as 2,2-dimethyl-7-t-butyl-6-hydroxychroman), 1,4-dihydropyridines (such as 2,6-dimethoxy-3,5-dicarbethoxy-1,4-dihydropyridine), ascorbic acid derivatives (such as 1-ascorbylpalmitate, ascorbylstearate and unsaturated aldehydes and ketones), 3-pyrazolidones, and certain indane-1,3-diones.

An additional class of reducing agents that can be used as developers are substituted hydrazines including the sulfonyl hydrazides described in U.S. Pat. No. 5,464,738 (Lynch et al.). Still other useful reducing agents are described, for example, in U.S. Pat. No. 3,074,809 (Owen), U.S. Pat. No. 3,094,417 (Workman), U.S. Pat. No. 3,080,254 (Grant, Jr.) and U.S. Pat. No. 3,887,417 (Klein et al.). Auxiliary reducing agents may be useful as described in U.S. Pat. No. 5,981,151 (Leenders et al.). All of these patents are incorporated herein by reference.

Useful co-developer reducing agents can also be used as described for example, in copending U.S. Pat. No. 6,387,605 (Lynch et al.), incorporated herein by reference. Examples of these compounds include, but are not limited to, 2,5-dioxo-cyclopentane carboxaldehydes, 5-(hydroxymethylene)-2,2-dimethyl-1,3-dioxane-4,6-diones, 5-(hydroxymethylene)-1,3-dialkylbarbituric acids, and 2-(ethoxymethylene)-1H-indene-1,3(2H)-diones.

Additional classes of reducing agents that can be used as co-developers are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.). All of the patents above are incorporated herein by reference.

Yet another class of co-developers includes substituted acrylonitrile compounds that are described in U.S. Pat. No. 5,635,339 (Murray) and U.S. Pat. No. 5,545,515 (Murray et al.), both incorporated herein by reference. Examples of such compounds include, but are not limited to, the compounds identified as HET-01 and HET-02 in U.S. Pat. No. 5,635,339 (noted above) and CN-01 through CN-13 in U.S. Pat. No. 5,545,515 (noted above). Particularly useful compounds of this type are (hydroxymethylene)cyanoacetates and their metal salts.

Various contrast enhancers can be used in some photothermographic materials with specific co-developers. Examples of useful contrast enhancers include, but are not limited to, hydroxylamines (including hydroxylamine and alkyl- and aryl-substituted derivatives thereof), alkanolamines and ammonium phthalamate compounds as described for example, in U.S. Pat. No. 5,545,505 (Simpson), hydroxamic acid compounds as described for example, in U.S. Pat. No. 5,545,507 (Simpson et al.), N-acylhydrazine compounds as described for example, in U.S. Pat. No. 5,558,983 (Simpson et al.), and hydrogen atom donor compounds as described in U.S. Pat. No. 5,637,449 (Harring et al.). All of the patents above are incorporated herein by reference.

The reducing agent (or mixture thereof) described herein is generally present as 1to 10% (dry weight) of the emulsion layer. In multilayer constructions, if the reducing agent is added to a layer other than an emulsion layer, slightly higher proportions, of from about 2 to 15 weight % may be more desirable. Any co-developers may be present generally in an amount of from about 0.001% to about 1.5% (dry weight) of the emulsion layer coating.

For color imaging materials (for example, monochrome, dichrome, or full color images), one or more reducing agents can be used that can be oxidized directly or indirectly to form or release one or more dyes.

The dye-forming or releasing compound may be any colored, colorless, or lightly colored compound that can be oxidized to a colored form, or to release a preformed dye when heated, preferably to a temperature of from about 80° C. to about 250° C. for a duration of at least 1 second. When used with a dye- or image-receiving layer, the dye can diffuse through the imaging layers and interlayers into the image-receiving layer of the photothermographic material.

Leuco dyes or "blocked" leuco dyes are one class of dye-forming compounds (or "blocked" dye-forming compounds) that form and release a dye upon oxidation by silver ion to form a visible color image in the practice of the present invention. Leuco dyes are the reduced form of dyes that are generally colorless or very lightly colored in the visible region (optical density of less than 0.2). Thus, oxidation provides a color change that is from colorless to colored, an optical density increase of at least 0.2 units, or a substantial change in hue.

Representative classes of useful leuco dyes include, but are not limited to, chromogenic leuco dyes (such as indoaniline, indophenol, or azomethine dyes), imidazole leuco dyes such as 2-(3,5-di-t-butyl-4-hydroxyphenyl)-4,5-diphenylimidazole as described for example in U.S. Pat. No. 3,985,565 (Gabrielson et al.), dyes having an azine, diazine, oxazine, or thiazine nucleus such as those described for example in U.S. Pat. No. 4,563,415 (Brown et al.), U.S. Pat. No. 4,622,395 (Bellus et al.), U.S. Pat. No. 4,710,570 (Thien), and U.S. Pat. No. 4,782,010 (Mader et al.), and benzlidene leuco compounds as described for example in U.S. Pat. No. 4,932,792 (Grieve et al.), all incorporated herein by reference. Further details about the chromogenic leuco dyes noted above can be obtained from U.S. Pat. No. 5,491,059 (noted above, Column 13) and references noted therein.

Another useful class of leuco dyes includes what are known as "aldazine" and "ketazine" leuco dyes that are described for example in U.S. Pat. No. 4,587,211 (Ishida et al.) and U.S. Pat. No. 4,795,697 (Vogel et al.), both incorporated herein by reference.

Still another useful class of dye-releasing compounds includes those that release diffusible dyes upon oxidation. These are known as preformed dye release (PDR) or redox dye release (RDR) compounds. In such compounds, the reducing agents release a mobile preformed dye upon oxidation. Examples of such compounds are described in U.S. Pat. No. 4,981,775 (Swain), incorporated herein by reference.

Further, other useful image-forming compounds are those in which the mobility of a dye moiety changes as a result of an oxidation-reduction reaction with silver halide, or a nonphotosensitive silver salt at high temperature, as described for example in JP Kokai 165,054/84.

Still further, the reducing agent can be a compound that releases a conventional photographic dye forming color coupler or developer upon oxidation as is known in the photographic art.

The dyes that are formed or released can be the same in the same or different imaging layers. A difference of at least 60 nm in reflective maximum absorbance is preferred. More preferably, this difference is from about 80 to about 100 nm. Further details about the various dye absorbances are provided in U.S. Pat. No. 5,491,059 (noted above, Col. 14).

The total amount of one or more dye-forming or releasing compound that can be incorporated into the photothermographic materials of this invention is generally from about 0.5 to about 25 weight % of the total weight of each imaging layer in which they are located. Preferably, the amount in each imaging layer is from about 1 to about 10 weight %, based on the total dry layer weight. The useful relative proportions of the leuco dyes would be readily known to a skilled worker in the art.

Other Addenda

The photothermographic materials of the invention can also contain other additives such as shelf-life stabilizers, toners, antifoggants, contrast enhancers, development accelerators, acutance dyes, post-processing stabilizers or stabilizer precursors, and other image-modifying agents as would be readily apparent to one skilled in the art.

To further control the properties of photothermographic materials, (for example, contrast, $D_{min}$, speed, or fog), it may be preferable to add one or more heteroaromatic mercapto compounds or heteroaromatic disulfide compounds of the formulae Ar—S—M and Ar—S—S—Ar, wherein M represents a hydrogen atom or an alkali metal atom and Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Compounds having other heteroaromatic rings and compounds providing enhanced sensitization at other wavelengths are also envisioned to be suitable. For example, heteroaromatic mercapto compounds are described as supersensitizers for infrared photothermographic materials in EP-A-0 559 228 (Philip Jr. et al.).

The heteroaromatic ring may also carry substituents. Examples of preferred substituents are halo groups (such as bromo and chloro), hydroxy, amino, carboxy, alkyl groups (for example, of 1 or more carbon atoms and preferably 1 to 4 carbon atoms), and alkoxy groups (for example, of 1 or more carbon atoms and preferably of 1 to 4 carbon atoms).

Heteroaromatic mercapto compounds are most preferred. Examples of preferred heteroaromatic mercapto compounds are 2-mercaptobenzimidazole, 2-mercapto-5-methylbenzimidazole, 2-mercaptobenzothiazole and 2-mercaptobenzoxazole, and mixtures thereof.

If used, a heteroaromatic mercapto compound is generally present in an emulsion layer in an amount of at least about 0.0001 mole per mole of total silver in the emulsion layer. More preferably, the heteroaromatic mercapto compound is present within a range of about 0.001 mole to about 1.0 mole, and most preferably, about 0.005 mole to about 0.2 mole, per mole of total silver.

The photothermographic materials of the present invention can be further protected against the production of fog and can be stabilized against loss of sensitivity during storage. While not necessary for the practice of the invention, it may be advantageous to add mercury (II) salts to the emulsion layer(s) as an antifoggant. Preferred mercury (II) salts for this purpose are mercuric acetate and mercuric bromide. Other useful mercury salts include those described in U.S. Pat. No. 2,728,663 (Allen).

Other suitable antifoggants and stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder), compounds having —$SO_2CBr_3$ groups as described for example in U.S. Pat. No. 5,594,143 (Kirk et al.) and U.S. Pat. No. 5,374,514 (Kirk et al.), and 2-(tribromomethylsulfonyl)quinoline compounds as described in U.S. Pat. No. 5,460,938 (Kirk et al.).

Stabilizer precursor compounds capable of releasing stabilizers upon application of heat during development can also be used. Such precursor compounds are described in for example, U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzotriazoles (for example alkylsulfonylbenzotriazoles and arylsulfonylbenzotriazoles) have been found to be useful stabilizing compounds (such as for post-processing print stabilizing), as described in U.S. Pat. No. 6,171,767 (Kong et al).

Furthermore, other specific useful antifoggants/stabilizers are described in more detail in U.S. Pat. No. 6,083,681 (Lynch et al.), incorporated herein by reference.

Other antifoggants are hydrobromic acid salts of heterocyclic compounds (such as pyridinium hydrobromide perbromide) as described, for example, in U.S. Pat. No. 5,028,523 (Skoug), benzoyl acid compounds as described, for example, in U.S. Pat. No. 4,784,939 (Pham), substituted propenenitrile compounds as described, for example, in U.S. Pat. No. 5,686,228 (Murray et al.), silyl blocked compounds as described, for example, in U.S. Pat. No. 5,358,843 (Sakizadeh et al.), vinyl sulfones as described, for example, in EP-A-0 600,589 (Philip, Jr. et al.) and EP-A-0 600,586 (Philip, Jr. et al.), and tribromomethylketones as described, for example, in EP-A-0 600,587 (Oliff et al.).

Preferably, the photothermographic materials include one or more polyhalo antifoggants that include one or more polyhalo substituents including but not limited to, dichloro, dibromo, trichloro, and tribromo groups. The antifoggants can be aliphatic, alicyclic or aromatic compounds, including aromatic heterocyclic and carbocyclic compounds.

Particularly useful antifoggants are polyhalo antifoggants, such as those having a —$SO_2C(X')_3$ group wherein X' represents the same or different halogen atoms.

The use of "toners" or derivatives thereof that improve the image is highly desirable. Preferably, if used, a toner can be present in an amount of about 0.01% by weight to about 10%, and more preferably about 0.1% by weight to about 10% by weight, based on the total dry weight of the layer in which it is included. Toners may be incorporated in the photothermographic emulsion layer or in an adjacent layer. Toners are well known materials in the photothermographic art, as shown in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.) and GB 1,439,478 (AGFA).

Examples of toners include, but are not limited to, phthalimide and N-hydroxyphthalimide, cyclic imides (such as succinimide), pyrazoline-5-ones, quinazolinone, 1-phenylurazole, 3-phenyl-2-pyrazoline-5-one, and 2,4-thiazolidinedione, naphthalimides (such as N-hydroxy-1,8-naphthalimide), cobalt complexes (such as hexaaminecobalt (3+) trifluoroacetate), mercaptans (such as 3-mercapto-1,2,4-triazole, 2,4-dimercaptopyrimidine, 3-mercapto-4,5-diphenyl-1,2,4-triazole and 2,5-dimercapto-1,3,4-thiadiazole), N-(aminomethyl)aryldicarboximides (such as (N,N-dimethylaminomethyl)phthalimide), and N-(dimethylaminomethyl)naphthalene-2,3-dicarboximide, a combination of blocked pyrazoles, isothiuronium derivatives, and certain photobleach agents [such as a combination of N,N'-hexamethylene-bis(1-carbamoyl-3,5-dimethylpyrazole), 1,8-(3,6-diazaoctane)bis(isothiuronium) trifluoroacetate, and 2-(tribromomethylsulfonyl benzothiazole)], merocyanine dyes {such as 3-ethyl-5-[(3-ethyl-2-benzothiazolinylidene)-1-methyl-ethylidene]-2-thio-2,4-o-azolidinedione}, phthalazine and derivatives thereof [such as those described in U.S. Pat. No. 6,146,822 (Asanuma et al.)], phthalazinone and phthalazinone derivatives, or metal salts or these derivatives [such as 4-(1-naphthyl)phthalazinone, 6-chlorophthalazinone, 5,7-dimethoxyphthalazinone, and 2,3-dihydro-1,4-phthalazinedione], a combination of phthalazine (or derivative thereof) plus one or more phthalic acid derivatives (such as phthalic acid, 4-methylphthalic acid, 4-nitrophthalic acid, and tetrachlorophthalic anhydride), quinazolinediones, benzoxazine or naphthoxazine derivatives, rhodium complexes functioning not only as tone modifiers but also as sources of halide ion for silver halide formation in situ [such as ammonium hexachlororhodate (III), rhodium bromide, rhodium nitrate, and potassium hexachlororhodate (III)], benzoxazine-2,4-diones (such as 1,3-benzoxazine-2,4-dione, 8-methyl-1,3-benzoxazine-2,4-dione and 6-nitro-1,3-benzoxazine-2,4-dione), pyrimidines and asym-triazines (such as 2,4-dihydroxypyrimidine, 2-hydroxy-4-aminopyrimidine and azauracil) and tetraazapentalene derivatives [such as 3,6-dimercapto-1,4-diphenyl-1H,4H-2,3a,5,6a-tetraazapentalene and 1,4-di-(o-chlorophenyl)-3,6-dimercapto-1H,4H-2,3a,5,6a-tetraazapentalene].

Phthalazines and phthalazine derivatives [such as those described in U.S. Pat. No. 6,146,822 (noted above), incorporated herein by reference] are particularly useful toners.

Binders

The photocatalyst (such as photosensitive silver halide), the non-photosensitive source of reducible silver ions, the reducing agent composition, and any other additives used in the present invention are generally added to one or more binders that are either hydrophilic or hydrophobic. Thus, either aqueous or solvent-based formulations can be used to prepare the photothermographic materials of this invention. Mixtures of either or both types of binders can also be used. It is preferred that the binder be selected from hydrophobic polymeric materials, such as, for example, natural and synthetic resins that are sufficiently polar to hold the other ingredients in solution or suspension.

Examples of typical hydrophobic binders include, but are not limited to, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable binders are polyvinyl butyral resins that are available as BUTVAR® B79 (Solutia, Inc.) and Pioloform BS-18 or Pioloform BL-16 (Wacker Chemical Company). Aqueous dispersions (or latexes) of hydrophobic binders may also be used.

Examples of useful hydrophilic binders include, but are not limited to, gelatin and gelatin-like derivatives (hardened or unhardened), cellulosic materials such as hydroxymethyl cellulose, acrylamide/methacrylamide polymers, acrylic/methacrylic polymers polyvinyl pyrrolidones, polyvinyl alcohols, and polysaccharides (such as dextrans and starch ethers).

Hardeners for various binders may be present if desired. Useful hardeners are well known and include diisocyanate compounds as described for example in EP-0 600 586B1 and vinyl sulfone compounds as described in EP-0 600 589B1.

Where the proportions and activities of the photothermographic materials require a particular developing time and temperature, the binder(s) should be able to withstand those conditions. Generally, it is preferred that the binder does not decompose or lose its structural integrity at 120° C. for 60 seconds. It is more preferred that it does not decompose or lose its structural integrity at 177° C. for 60 seconds.

The polymer binder(s) is used in an amount sufficient to carry the components dispersed therein. The effective range can be appropriately determined by one skilled in the art. Preferably, a binder is used at a level of about 10% by weight to about 90% by weight, and more preferably at a level of about 20% by weight to about 70% by weight, based on the total dry weight of the layer in which it is included.

Support Materials

The photothermographic materials of this invention comprise a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal development and to have suitable adhesive properties with overlying layers. Useful polymeric materials for making such supports include, but are not limited to, polyesters (such as polyethylene terephthalate and polyethylene naphthalate), cellulose acetate and other cellulose esters, polyvinyl acetal, polyolefins (such as polyethylene and polypropylene), polycarbonates, and polystyrenes (and polymers of styrene derivatives). Preferred supports are composed of polymers having good heat stability, such as polyesters and polycarbonates. Polyethylene terephthalate film is the most preferred support. Various support materials are described, for example, in *Research Disclosure,* August 1979, item 18431. A method of making dimensionally stable polyester films is described in *Research Disclosure,* September, 1999, item 42536.

Opaque supports can also be used, such as dyed polymeric films and resin-coated papers that are stable to high temperatures.

Support materials can contain various colorants, pigments, antihalation or acutance dyes if desired. Support materials may be treated using conventional procedures (such as corona discharge) to improve adhesion of overlying layers, or subbing or other adhesion-promoting layers can be used. Useful subbing layer formulations include those conventionally used for photographic materials such as vinylidene halide polymers.

Support materials may also be treated or annealed to reduce shrinkage and promote dimensional stability.

Photothermographic Formulations

The formulation for the photothermographic emulsion layer(s) can be prepared by dissolving and dispersing the binder, the photocatalyst, the non-photosensitive source of reducible silver ions, the reducing composition, and optional addenda in an organic solvent, such as toluene, 2-butanone (methyl ethyl ketone), acetone, or tetrahydrofuran.

Alternatively, these components can be formulated with a hydrophilic binder in water or water-organic solvent mixtures to provide aqueous-based coating formulations.

Photothermographic materials of the invention can contain plasticizers and lubricants such as polyalcohols and diols of the type described in U.S. Pat. No. 2,960,404 (Milton et al.), fatty acids or esters such as those described in U.S. Pat. No. 2,588,765 (Robijns) and U.S. Pat. No. 3,121,060 (Duane), and silicone resins such as those described in GB 955,061 (DuPont). The materials can also contain matting agents such as starch, titanium dioxide, zinc oxide, silica, and polymeric beads including beads of the type described in U.S. Pat. No. 2,992,101 (Jelley et al.) and U.S. Pat. No. 2,701,245 (Lynn). Polymeric fluorinated surfactants may also be useful in one or more layers of the imaging materials for various purposes, such as improving coatability and optical density uniformity as described in U.S. Pat. No. 5,468,603 (Kub).

EP-0 792 476 B1 (Geisler et al.) describes various means of modifying photothermographic materials to reduce what is known as the "woodgrain" effect, or uneven optical density. This effect can be reduced or eliminated by several means, including treatment of the support, adding matting agents to the topcoat, using acutance dyes in certain layers or other procedures described in the noted publication.

The photothermographic materials of this invention can include antistatic or conducting layers. Such layers may contain soluble salts (for example, chlorides or nitrates), evaporated metal layers, or ionic polymers such as those described in U.S. Pat. No. 2,861,056 (Minsk) and U.S. Pat. No. 3,206,312 (Sterman et al.), or insoluble inorganic salts such as those described in U.S. Pat. No. 3,428,451 (Trevoy), electroconductive underlayers such as those described in U.S. Pat. No. 5,310,640 (Markin et al.), electronically-conductive metal antimonate particles such as those described in U.S. Pat. No. 5,368,995 (Christian et al.), and electrically-conductive metal-containing particles dispersed in a polymeric binder such as those described in EP-A-0 678 776 (Melpolder et al.). Other antistatic agents are well known in the art.

The photothermographic materials can be constructed of one or more layers on a support. Single layer materials should contain the photocatalyst, the non-photosensitive source of reducible silver ions, the reducing composition, the binder, as well as optional materials such as toners, acutance dyes, coating aids and other adjuvants.

Two-layer constructions comprising a single imaging layer coating containing all the ingredients and a surface protective topcoat are generally found in the materials of this invention. However, two-layer constructions containing photocatalyst and non-photosensitive source of reducible silver ions in one imaging layer (usually the layer adjacent to the support) and the reducing composition and other ingredients in the second imaging layer or distributed between both layers are also envisioned.

Layers to promote adhesion of one layer to another in photothermographic materials are also known, as described for example in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described for example in U.S. Pat. No. 5,928,857 (Geisler et al.).

Layers to reduce emissions from the film may also be present, including the polymeric barrier layers described in copending U.S. Pat. No. 6,352,819 Kenney et al.), and U.S. Pat. Nos. 6,352,820 and 6,420,102 (Bauer et al.), all incorporated herein by reference.

Photothermographic formulations described can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.), and GB 837,095 (Ilford). A typical coating gap for the emulsion layer can be from about 10 to about 750 μm, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

When the layers are coated simultaneously using various coating techniques, a "carrier" layer formulation comprising a single-phase mixture of the two or more polymers described above may be used. Such formulations are described in U.S. Pat. No. 6,355,405 (Ludemann et al.).

Mottle and other surface anomalies can be reduced in the materials of this invention by incorporation of a fluorinated polymer as described for example in U.S. Pat. No. 5,532,121 (Yonkoski et al.) or by using particular drying techniques as described, for example in U.S. Pat. No. 5,621,983 (Ludemann et al.).

Preferably, two or more layers are applied to a film support using slide coating. The first layer can be coated on top of the second layer while the second layer is still wet. The first and second fluids used to coat these layers can be the same or different organic solvents (or organic solvent mixtures).

While the first and second layers can be coated on one side of the film support, manufacturing methods can also include forming on the opposing or backside of said polymeric support, one or more additional layers, including an antihalation layer, an antistatic layer, or a layer containing a matting agent (such as silica), or a combination of such layers.

An antihalation layer is essential to the present invention and is composed of an infrared radiation absorbing heat-bleachable composition of the present invention as described herein. It is also contemplated that the photothermographic materials of this invention can include emulsion layers on both sides of the support and at least one infrared radiation absorbing heat-bleachable compositions as an antihalation underlayer beneath at least one emulsion layer.

In preferred embodiments, the photothermographic materials of this invention include a surface protective layer on the same side of the support as the one or more thermally-developable layers, an antihalation layer on the opposite side of the support, or both a surface protective layer and an antihalation layer on their respective sides of the support.

To promote image sharpness, photothermographic materials according to the present invention can contain one or more frontside layers containing acutance dyes. These dyes are chosen to have absorption close to the exposure wavelength and are designed to absorb scattered light. In addition, one or more antihalation dyes may be incorporated into one or more antihalation layers according to known techniques as an antihalation underlayer, or as an antihalation overcoat. Additionally, one or more acutance dyes may be incorporated into one or more frontside layers such as the photothermographic emulsion layer, primer layer, underlayer, or topcoat layer according to known techniques.

Dyes useful as acutance dyes include dihydroperimidine squaraine dyes having the nucleus represented by the following general Structure:

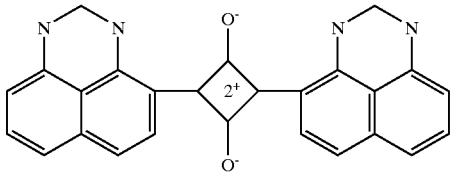

Details of such dyes having the dihydroperimidine squaraine nucleus and methods of their preparation can be found in U.S. Pat. No. 6,063,560 (Suzuki et al.) and U.S. Pat. No. 5,380,635 (Gomez et al.), both incorporated herein by reference. One particularly useful dihydroperimidine squaraine dye is cyclobutenediylium, 1,3-bis[2,3-dihydro-2,2-bis[[1-oxohexyl)oxy]methyl]-1H-perimidin-4-yl]-2,4-dihydroxy-, bis(inner salt).

Another class of dyes particularly useful as acutance dyes includes indolenine cyanine dyes having the nucleus represented by the following general structure:

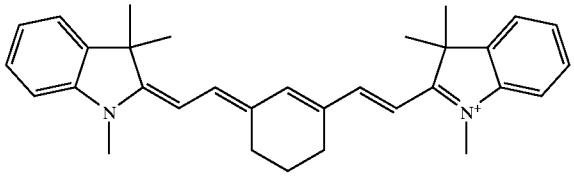

Details of such acutance dyes having the indolenine cyanine nucleus and methods of their preparation can be found in EP-A-0 342 810 (Leichter), incorporated herein by reference. One particularly useful cyanine dye, compound (6) described therein, is 3H-Indolium, 2-[2-[2-chloro-3-[(1,3-dihydro-1,3,3-trimethyl-2H-indol-2-ylidene)ethylidene]-5-methyl-1-cyclohexen-1-yl]ethenyl]-1,3,3-trimethyl-, perchlorate.

Heat-Bleachable Antihalation Compositions

The advantages of the present invention are provided by use of particular heat-bleachable infrared radiation-absorbing antihalation compositions in one or more antihalation layers of the photothermographic material. These compositions are preferably located on the backside of the photothermographic materials of this invention. Additionally or alternatively, one or more of these antihalation compositions may be incorporated into one or more frontside layers such as the phototherrnographic emulsion layer, primer layer, underlayer, or topcoat layer according to known techniques. Barrier layers separating these layers from the photothermographic emulsion layer are also envisioned. The use of these heat bleachable antihalation compositions may be in addition to the use of other acutance and antihalation dyes described herein.

Under practical conditions of use, the compositions are heated to provide bleaching at a temperature of at least 90° C. for at least 0.5 seconds. Preferably, bleaching is carried out at a temperature of from about 100° C. to about 200° C. for from about 5 to about 20 seconds. Most preferred bleaching is carried out within 20 seconds at a temperature of from about 110° C. to about 130° C.

In a general sense, the infrared radiation absorbing compounds are defined by the following Structure I:

$$A_1—L_1—A_2 \qquad \text{I}$$

wherein $A_1$ represents a group derived from a dye base, a heterocyclic group,or an electron-donating aromatic group, $A_2$ represents a group derived from a dye base, a heterocyclic group, a group derived from a dye acid, or an electron-donating aromatic group, and $L_1$ represents a conjugated linking group that maintains electron delocalization between $A_1$ and $A_2$ to provide infrared absorbance. $L_1$ includes at least 3 carbon atoms with alternating carbon-carbon single and double bonds, and preferably at least 5 carbon atoms, some of which can be part of one or more unsaturated carbocyclic or heterocyclic rings. One or more substituents can be positioned along the conjugated chain. Structure I is intended to exclude oxonol dyes.

In a preferred embodiment, $L_1$ is represented by the following formula $L_1$-a:

$L_1$-a $$=\!\!\left[(P_1—P_2)_{s_1}=P_3—P_4=P_5—(P_6=P_7)_{s_2}—(P_8=P_9)_{s_3}\right]—$$

wherein $P_1$, $P_2$, $P_3$, $P_4$, $P_5$, $P_6$, $P_7$, $P_8$, and $P_9$ independently represent methine groups or substituted methine groups that may optionally form a ring with one or more other methine groups, or with an auxochrome, $s_1$, s2, and $s_3$, are independently equal to 0 or 1. Exemplary substituents on methine groups $P_1$, $P_2$, $P_3$, $P_4$, $P_5$, $P_6$, $P_7$, $P_8$, and $P_9$, include but are not limited to substituted unsubstituted alkyl groups (such as methyl, ethyl, and 2-carboxyethyl), substituted or unsubstituted aryl groups (such as phenyl and o-carboxyphenyl), substituted or unsubstituted heterocyclic groups (such as thienyl and barbituric acid), halogen atoms (such as chlorine and bromine), substituted or unsubstituted alkoxy groups (such as methoxy and ethoxy), amino groups (such as N,N-diphenylamino, N-methyl-N-phenylamino, and N-methylpiperazino), and substituted or unsubstituted alkylthio groups (such as methylthio and ethylthio).

Substituents (especially alkyl groups) on adjacent or next adjacent methine groups can be joined together to provide one or more substituted or unsubstituted unsaturated 5-, 6- or 7-membered carbocyclic ring within the methine linkage. For example, $P_1$ and $P_2$, $P_2$ and $P_3$, $P_3$ and $P_4$, $P_4$ and $P_5$, $P_5$ and $P_6$, $P_6$ and $P_7$, $P_7$ and $P_8$, $P_8$ and $P_9$, $P_1$ and $P_3$, $P_2$ and $P_4$, $P_3$ and $P_5$, $P_4$ and $P_6$, $P_5$ and $P_7$, $P_6$ and $P_8$, and/or $P_7$ and $P_9$ can be joined together to form substituted or unsubstituted 5-, 6-, or 7-membered rings. Similarly, $P_1$, $P_3$, and $P_5$, $P_2$, $P_4$, and $P_6$, $P_3$, $P_5$, and $P_7$, $P_4$, $P_6$, and $P_8$, and/or $P_5$, $P_7$, and $P_9$ may be joined to form fused rings that are also preferably substituted or unsubstituted 5-, 6-, or 7-membered rings. Such rings may contain additional substituent groups (for example, halogen, methyl, methylthio, phenylthio, or diphenylamino).

Preferably, $P_1$, $P_2$, $P_3$, $P_4$, $P_5$, $P_6$, $P_7$, $P_8$, and $P_9$ are independently unsubstituted, or substituted with a substituted or unsubstituted alkyl group, or comprise adjacent or next adjacent alkyl groups that are joined together to form one or more unsaturated 5- to 6-membered substituted or unsubstituted rings.

In another preferred embodiment, $L_1$ is represented by the following formula $L_1$-b:

$L_1$-b $$=\!\!\left[(P_1—P_2)_{s_1}=P_3—P_4=P_5—(P_6=P_7)_{s_2}—(P_8=P_9)_{s_3}\right]\left[P_{10}\right]=$$

wherein $P_1$, $P_2$, $P_3$, $P_4$, $P_5$, $P_6$, $P_7$, $P_8$, $P_9$, $s_1$, $s_2$, and $s_3$ are as defined above, and $P_{10}$ represents a methine group or a substituted methine group that may optionally form a ring with one or more other methine groups, or with an auxochrome.

Representative $L_1$ groups useful in this invention include, but are not limited to, groups having the nuclei represented below by Structures $L_1$-1 to $L_1$-17.

$L_1$-1

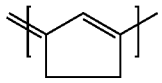

$L_1$-2

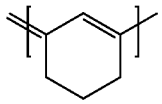

$L_1$-3

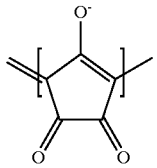

$L_1$-4

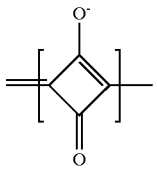

$L_1$-5

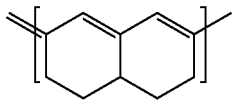

$L_1$-6

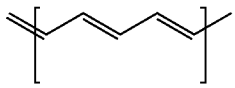

$L_1$-7

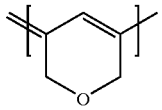

$L_1$-8

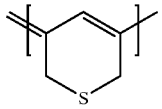

$L_1$-9

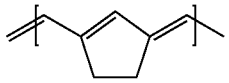

$L_1$-10

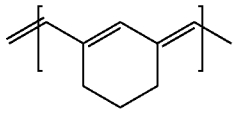

-continued $L_1$-11

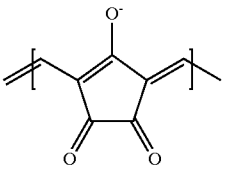

$L_1$-12

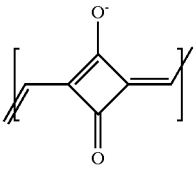

$L_1$-13

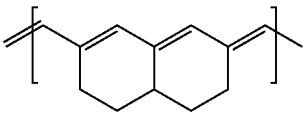

$L_1$-14

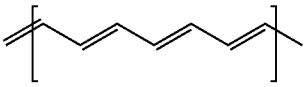

$L_1$-15

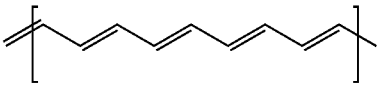

$L_1$-16

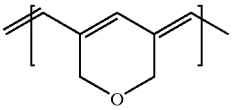

$L_1$-17

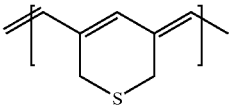

When $L_1$ is represented by $L_1$-3 or $L_1$-11, the dyes are often referred to as croconium dyes. When $L_1$ is represented by $L_1$-4 or $L_1$-12, the dyes are often referred to as squaraine or squarylium dyes.

Preferred infrared radiation-absorbing compounds can be represented by Structures II, III, IV, V, VI, VII, VIII, IX, and X described below.

In a preferred embodiment, $A_1$ and $A_2$ independently represent groups derived from a dye base and the infrared radiation-absorbing compound is represented by the following Structure II:

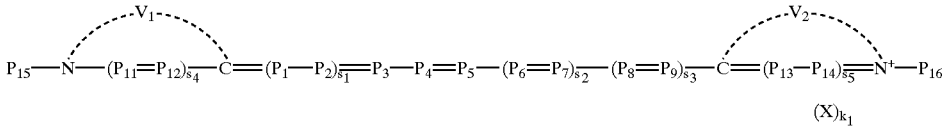

II wherein $V_1$ and $V_2$ independently represent the non-metallic atoms necessary to form substituted or unsubstituted 5-, 6-, or 7-membered heterocyclic rings, $P_{15}$ and $P_{16}$ independently represent alkyl, aryl, alkaryl, or heterocycl groups, $P_1$, $P_2$, $P_3$, $P_4$, $P_5$, $P_6$, $P_7$, $P_8$, $P_9$, $P_{11}$ and $P_{12}$, $P_{13}$, and $P_{14}$ independently represent methine groups or substituted methine groups that may optionally form a ring with one or more other methine groups or with an auxochrome, $s_1$, $s_2$, $s_3$, $s_4$, and $s_5$ are independently equal to 0 or 1, X is an electric charge neutralizing counterion, and $k_1$ is an integer inclusive of 0 is necessary to neutralize an electric charge in the molecule.

$V_1$ and $V_2$ independently represent the non-metallic atoms necessary to form substituted or unsubstituted 5-, 6-, or 7-membered heterocyclic rings that may also include in addition to the hetero nitrogen atom, a second hetero atom such as a second nitrogen, oxygen, selenium, or sulfur atom. $V_1$ and $V_2$ also may be further substituted, for example, to form additional rings fused to the heterocyclic nucleus, and have additional substituents attached thereon.

In a preferred embodiment the substituted methine groups represented by $P_1$, $P_2$, $P_3$, $P_4$, $P_5$, $P_6$, $P_7$, $P_8$, $P_9$, $P_{11}$, $P_{12}$, $P_{13}$ and $P_{14}$ may be further substituted with substituted or unsubstituted alkyl groups of up to 20 carbon atoms, substituted or unsubstituted aryl groups of up to 20 carbon atoms, halogen atoms (F, Cl, Br, and I), substituted or unsubstituted alkoxy, aryloxy, alkylthio, or arylthio groups of up to 20 carbon atoms (such as methoxy, ethoxy, phenoxy, thiomethyl, thioethyl, or thiophenyl), substituted or unsubstituted alkoxyalkylene groups, substituted or unsubstituted alkylthoalkeylene groups (such as methoxy-ethylene and ethoxythioetylene), primary, secondary, and tertiary amino groups of up to 20 carbon atoms, substituted or unsubstituted heterocyclic ring groups comprising up to 6 ring atoms, substituted or unsubstituted carbocyclic ring groups comprising up to 6 ring carbon atoms, and substituted or unsubstituted fused ring and bridging groups comprising up to 14 ring atoms.

In another preferred embodiment, the methine groups represented by $P_1$, $P_2$, $P_3$, $P_4$, $P_5$, $P_6$, $P_7$, $P_8$, and $P_9$, are independently substituted with alkyl or alkoxy groups of up to 6 carbon atoms, or are joined to form one or more substituted or unsubstituted 5-, 6-, or 7-membered rings, or two or more fused substituted or unsubstituted 5-, 6-, or 7-membered rings.

Preferably, $P_{15}$ and $P_{16}$ are independently substituted or unsubstituted alkyl groups having 1 to 10 carbon atoms (such as methyl, ethyl, n-propyl, iso-propyl, n-hexyl, benzyl, n-butyl, alkylcarboxy groups, carboxyethyl, carboxybutyl, sulfobutyl, and sulfopropyl), substituted or unsubstituted aralkyl groups (such as benzyl and diphenylmethyl groups), or substituted or unsubstituted aryl groups having 6 to 10 carbon atoms in the aromatic ring system (such as phenyl, naphthyl, p-methylphenyl, 2,4-ethylphenyl, 2,4-dimethylphenyl, p-chlorophenyl, and 3-methoxyphenyl groups). Other useful alkyl and aryl groups would be readily apparent to one skilled in the art.

More preferably, $P_{15}$ and $P_{16}$ are independently substituted or unsubstituted alkyl groups having 1 to 6 carbon atoms, and even more preferably, $P_{15}$ and $P_{16}$ are independently substituted or unsubstituted methyl, ethyl, n-propyl, or n-butyl groups, or alkylcarboxy groups.

The portion of Structure II derived from a dye base that is represented by $A_1$ and $A_2$ may be represented by the following Structures II-a and II-b:

II-a

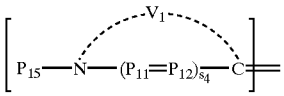

II-b

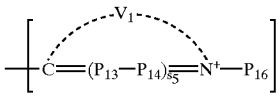

wherein $V_1$, $V_2$, $P_{11}$, $P_{12}$, $P_{13}$, $P_{14}$, $P_{15}$, $P_{16}$, $s_4$, and $s_5$ are as described above.

Preferred dye base nuclei represented by II-a and II-b are benzothiazole, naphthothiazole, benzoxazole, naphthoxazole, benzimidazole, 3,3-dialkylindolenine, 2-quinoline, and 4-quinoline nuclei.

Representative examples of dye bases represented by Structures II-a and II-b include but are not limited to, thiazole, 4-methylthiazole, 4-phenylthiazole, 5-methylthiazole, 5-phenylthiazole, 4,5-dimethylthiazole, 4,5-diphenylthiazole, 4-(2-thienyl)thiazole, benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 4-phenylbenzothiazole, 5-phenylbenzothiazole, 4-methoxybenzothiazole, 5-methoxybenzothiazole, 6-methoxybenzothiazole, 5-iodobenzothiazole, 6-iodobenzothiazole, 4-ethoxybenzothiazole,5-ethoxybenzothiazole, tetrahydrobenzothiazole, 5,6-dimethoxybenzothiazole, 5,6-dioxymethylenebenzothiazole, α-naphthothiazole, β-naphthothiazole, 5-methoxy-β-naphthothiazole, 5-ethoxy-β-naphthothiazole, 8-methoxy-α-naphthothiazole, 7-methoxy-α-naphthothiazole, 4'-methoxythianaphthen-7', 6', 5-othiazole, oxazole, 4-methyloxazole, 5-methyloxazole, 4-phenyloxazole, 7',6',4,5-diphenyloxazole, 4-ethyloxazole, 4,5-dimethyloxazole, 5-phenyloxazole, benzoxazole, 5-chlorobenzoxazole, 5-methylbenzoxazole, 5-phenylbenzoxazole, 6-methylbenzoxazole, 5,6-dimethylbenzoxazole, 4,6-dimethylbenzoxazole, 5-methoxybenzoxazole, 5-ethoxybenzoxazole, 6-chlorobenzoxazole, 6-methoxybenzoxazole, α-naphthoxazole, β-naphthoxazole, 4-methylselenazole, 4-phenylselenazole, benzoselenazole, 5-chlorobenzoselenazole, 5-methoxybenzoselenazole, 4,5,6,7-tetrahydrobenzoselenazole, α-naphthoselenazole, β-naphthoselenazole, thiazoline, 4-methylthiazoline, quinoline, 3-methylquinoline, 5-methylquinoline, 7-methylquinoline, 8-methylquinoline, 6-chloroquinoline, 8-chloroquinoline, 6-methoxyquinoline, 6-ethoxyquinoline, 3,4-dihydro-3,3-dimethylquinoline, isoquinoline, 3,4-dihydroisoquinoline, 3,3-dimethylindolenine, 3,3,5-trimethylindolenine, 3,3,7-trimethylindolenine, pyridine, 3-methylpyridine, 6-methylpyridine, 5-ethylpyridine, 3,5-dimethylpyridine, 3-chloropyridine, 5-phenylpyridine, 2-methylpyridine, 3-methylpyridine, 2,6-dimethylpyridine, 1-methylimidazole, 1-ethyl-4-phenylimidazole, 1-butyl-4,5-dimethylimidazole, 1-methylbenzimidazole, 1-butyl-4-methylbenzimidazole, 1-ethyl-5,6-dichlorobenzimidazole, 1-ethyl-α-naphthimidazole, 1-methyl-β-naphthimidazole, tellurazole, benzotellurazole, naphthotellurazole, and imidazo-4,5-[b]quinoxaline].

As noted above, X represents a suitable charge-neutralizing counterion, anion or cation, or combination thereof, and $k_1$ is an integer inclusive of 0 sufficient to neutralize an electric charge in the molecule. Whether a certain dye is a cation or anion, or whether or not a certain dye has a net ionic charge, depends on its structure and substituents. The cation is typically an inorganic or organic ammonium ion or alkali metal ion, including, but not limited to, alkali metal cations, ammonium, alkylammonium, dialkylammonium, trialkylammonium, and tetraalkylammonium. The anion may be either an inorganic or an organic anion, such as halide, alkylsulfonate, arylsulfonate, aryldisulfonate, alkylsulfate, alkylsulfonyl methide and amide, sulfate ion, thiocyanate ion, perchlorate ion, tetrafluoroborate ion, picrate ion, acetate ion, hexafluorophosphate, hexafluoroantimonate and trifluoromethanesulfonate ion. Preferred anions are halide, perchlorate, and p-toluenesulfonate ions. In addition, $k_1$ is selected so that the compounds represented in Structure I have a total net charge of zero. Anions having a single negative charge and represented by the formula $X^-$ are preferred.

In another preferred embodiment, $A_1$ and $A_2$ independently represent groups derived from heterocyclic groups, and the infrared radiation-absorbing compound is represented by the following Structure III:

III

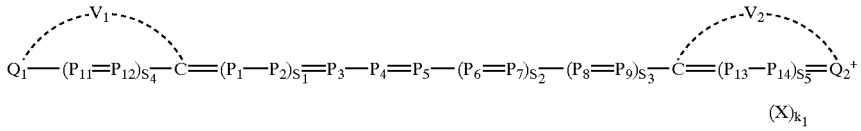

wherein $Q_1$ and $Q_2$ independently represent heteroatoms (such as N, O, S, Se, or Te), $V_1$ and $V_2$ independently represent the non-metallic atoms necessary to form substituted or unsubstituted 5-, 6- or 7-membered heterocyclic rings that may be further fused to additional carbocyclic or heterocyclic rings, and $P_1$, $P_2$, $P_3$, $P_4$, $P_5$, $P_6$, $P_7$, $P_8$, $P_9$, $P_{11}$, $P_{12}$, $P_{13}$, $P_{14}$, $s_1$, $s_2$, $s_3$, $s_4$, $s_5$, X, and $k_1$ are as described The portion of Structure III derived from a heterocyclic group that is represented by $A_1$ and $A_2$ may be independently represented by the following Structures III-a and III-b:

III-a

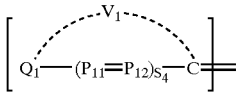

III-b

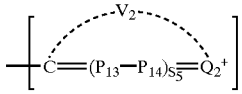

wherein $Q_1$ and $Q_2$ independently represent N, O, S, Se, or Te, and $V_1$, $V_2$, $P_{11}$, $P_{12}$, $P_{13}$, $P_{14}$, $P_{15}$, $P_{16}$, $s_4$, and $s_5$ are as described above.

Representative examples of heterocyclic groups include but are not limited to, N-butyl-2,4,5-trimethylpyrrolo, N-(3,4-dichlorophenyl)-2,5-dimethylpyrrolo, 5-dimethylamino-2-thienyl, 4,5-dimethyl-2-thienyl, N-(2'-cyanoethyl)-2,5-dimethyl-3-indolo, N-methyl-2,5-diphenylpyrrolo, 2,6-di-tert-butyl-4-pyryl, 2,6-dimethyl-4-pyryl, 2,6-di-tert-butyl-4-thiopyryl, 2,6-dimethyl-4-thiopyryl, 2,6-diphenyl-4-thiopyryl, 4,6-dimethyl-2-pyryl, 4,6-diphenyl-2-pyryl, 2-chromenyl, 2-thiochromenyl, 2-tert-4-chromenyl, 2-phenyl-4-thiochromenyl, 2,6-di-tert-butyl-4-selenopyryl, and 2,6-di-tert-butyl-4-telluropyryl.

In another preferred embodiment, $A_1$ represents a group derived from a dye base and $A_2$ represents a group derived from a dye acid, and the infrared radiation-absorbing compound is represented by the following Structure IV:

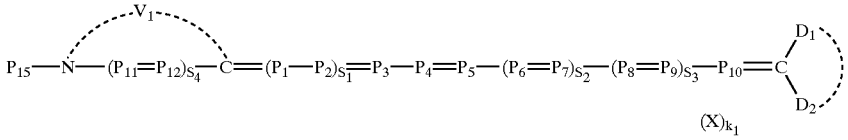

IV wherein $P_{10}$ represents a methine group or a substituted methine group that may optionally form a ring with one or more other methine groups or a ring with an auxochrome, $D_1$ and $D_2$ independently represent the atoms necessary to form acidic acyclic, carbocyclic, or heterocyclic nuclei, and $V_1$, $P_1$, $P_2$, $P_3$, $P_4$, $P_5$, $P_6$, $P_7$, $P_8$, $P_9$, $P_{10}$, $P_{11}$, $P_{12}$, $P_{15}$, $s_1$, $s_2$ $s_3$, $s_4$, X, and $k_1$ are as described above. In one embodiment, $D_2$ is a sulfonyl, thiocarbonyl, or carbonyl group and $D_1$ represents the remaining atoms necessary to form a substituted or unsubstituted carbocyclic or heterocyclic nucleus.

In Structure IV, the group derived from a dye acid may be represented by the following Structure IV-b:

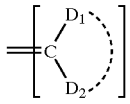

IV-b wherein $D_1$, and $D_2$ are as described above.

In one embodiment, $D_2$ is a carbonyl, thiocarbonyl, sulfonyl, or dicyanomethylene group and $D_1$ represents the remaining atoms necessary to form the acidic carbocyclic or heterocyclic nucleus. Acidic nuclei are defined in C. E. K. Mees and T. H. James, *The Theory of the Photographic Process*, Fourth Edition, 1977, pp. 198–200.

Preferably, $D_1$ and $D_2$, taken together, form a substituted or unsubstituted 5-, 6-, or 7-membered heterocycle consisting of carbon, nitrogen, and chalcogen (typically oxygen, sulfur, selenium, and tellurium) atoms.

Representative examples of the dye acid nucleus formed by $D_1$ and $D_2$ include but are not limited to, nuclei of 2-pyrazolin-5-one, pyrazolidine-3,5-dione, imidazolin-5-one, hydantoin, 2- or 4-thiohydantoin, 2-iminooxazolidin-4-one, 2-oxazolin-5-one, 2-thiooxazolidine-2,4-dione, isooxazolin-5-one, 2-thiazolin-4-one, thiazolidin-4-one, thiazolidine-2,4-dione, rhodanine, thiazolidine-2,4-dithion, isorhodanine, indane-1,3-dione, thiophen-3-one, thiophen-3-one-1,1-dioxide, indolin-2-one, indolin-3-one, indazolin-3-one, 2-oxoindazolinium, 3-oxoindazolinium, 5,7-dioxo-6,7-dibydrothiazolo[3,2-a]-pyrimidine, cyclohexane-1,3-dione, 3,4-dihydroisoquinolin-4-one, 1,3-dioxane-4,6-dione, barbituric acid, 2-thiobarbituric acid, chroman-2,4-dione, indazolin-2-one, and pyrido[1,2-a]pyrimidine-1,3-dione, as well as nuclei having an exo-methylene structure wherein the carbonyl or thiocarbonyl group of the foregoing nuclei is replaced by an active methylene site of an active methylene compound having such a structure as ketomethylene and cyanomethylene. More preferred are nuclei of 3-alkylrhodanine, 3-alkyl-2-thiooxazolidine-2,4-dione, and 3-alkyl-2-thiohydantoin, and especially those nuclei having at least one carboxyl group.

The portion of Structure IV derived from a dye base that is represented by $A_1$ is identical to that described above for Structures II-a and II-b:

Moreover, in another preferred embodiment, $A_1$ and $A_2$ independently represent groups derived from electron-donating aromatic groups, and the infrared radiation-absorbing compound is represented by the following Structure V:

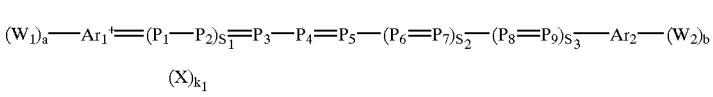

V wherein $Ar_1$ and $Ar_2$ independently represent aromatic groups, $W_1$ and $W_2$ independently represent electron-donating substituent groups, "a" and "b" independently represent integers from 0 to 5, and $P_1$, $P_2$, $P_3$, $P_4$, $P_5$, $P_6$, $P_7$, $P_8$, $P_9$, $s_1$, $s_2$, $s_3$ X, and $k_1$ are as described above.

The portion of Structure V derived from an aryl group that optionally bears an electron-donating substituent represented by $A_1$ and $A_2$ may be represented by the following Structures V-a and V-b:

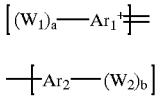

V-a

V-b wherein $Ar_1$ and $Ar_2$ independently represent aryl groups having 6 to 10 ring atoms, $W_1$ represents a electron-donating substituent group having up to about 20 atoms such as an amino group having the formula $R_1R_2N$-, an ether or thioether group having the formula $R_1O$ or $R_1S$ where $R_1$ and $R_2$ independently represent alkyl groups having 1 to 12 carbon atoms (preferably 1 to 4 carbon atoms), cyanoalkyl groups of 1 to 4 carbon atoms (preferably cyanomethyl or cyanoethyl), aryl groups, alkaryl groups, or arylene groups having 6 to 10 ring atoms (preferably phenyl, tolyl, or phenylene) and having less than about 15 total carbon atoms, an alkylene, alkyleneoxy, alkylene-tert-amino, or alkylenethio group of 1 to 3 carbon atoms, an alkyleneacylamino having 1 to 3 ring atoms, an aralkyl group (such as benzyl) of up to about 15 total carbon atoms, or $R_1$ or $R_2$ together may represent the necessary atoms to complete a substituted or unsubstituted 5-, 6-, or 7-membered heterocyclic ring, or $R_1$ or $R_2$ may represent the atoms necessary to form a substituted or unsubstituted 5-, 6- or 7-membered heterocyclic ring group fused to the phenyl ring on which the $NR_1R_2$ group is attached.

In addition, "a" and "b" independently represent integer from 0 to 5. Preferably, "a" and "b" are 1 or 2.

Moreover, $s_1$, $s_2$, and $s_3$ are independently 0 or 1.

It is to be understood that, when either of "a" or "b" is 2 or more, each $W_1$ and each $W_2$, respectively, may be different from each other. For example, if "a" is 2, a first $W_1$ could be $(C_2H_5)_2N$— and a second $W_1$ could be $C_2H_5O$—.

Preferred aryl groups substituted with electron releasing groups represented by V-a and V-b are aminophenyl, aminonaphthyl, diaminonaphthyl, and dihydroperimidine groups.

Representative examples of aryl groups represented by Structures IV-a and IV-b include but are not limited to, 4-diethylaminophenyl, 4-dimethylaminophenyl, 4-dimethylamino-1-naphthyl, 6-chloro-4-diethylamino-1-naphthyl, 2,4,5-trimethoxyphenyl, 2-fluoro-4-dimethylaminophenyl, 3-fluoro-4-dimethylamino-5-ethoxyphenyl, 3,4-methylenedioxyphenyl, 2-chloro-4-N-pyrrolidinophenyl, N-n-butyl-5-indolino, N-ethyl-6-(1,2,3,4,-tetrahydro)quinolino, N'-(2"-ethylhexyl)-4-(N-piperazino)phenyl, 2,4-bis(methylthio)phenyl, 2-methyl-4-(4'-methylpiperidino)phenyl, 4-(N-2'-chloroethyl-N-propylamino)phenyl, 4-(N-methylacetamido)phenyl, 2-(N-piperidino)phenyl, phenyl, 4-(N'-phenylpiperazino)phenyl, 4-julolidino, 4-(N-morpholino)phenyl, 4-(N-pyrrolidino)-3-fluorophenyl, 2,3-dihydro-1H-4-perimidine, 2,3-dihydro-1H-6-perimidine, and 1,4-dimethyl-7-isopropylazuleno.

In another preferred embodiment, $A_1$ represents a group derived from a dye base, and $A_2$ represents an electron-donating aromatic group, and the infrared radiation-absorbing compound is represented by the following Structure VI:

VI

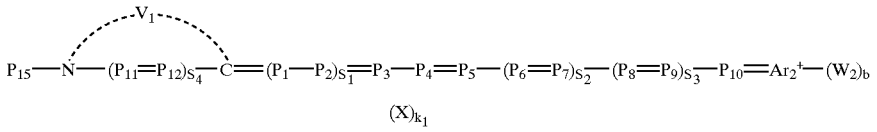

wherein $V_1$, $P_1$, $P_2$, $P_3$, $P_4$, $P_5$, $P_6$, $P_7$, $P_8$, $P_9$, $P_{10}$, $P_{11}$, $P_{12}$, $P_{13}$, $P_{14}$, $P_{15}$, $s_1$, $s_2$, $s_3$, $s_4$, $Ar_2$, $W_2$, b, X, and $k_1$ are as described above.

In another preferred embodiment, $A_1$ represents a group derived from a dye base, and $A_2$ represents a heterocyclic group, and the infrared radiation-absorbing compound is represented by the following Structure VII:

VII

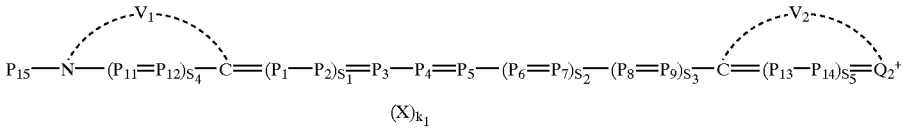

wherein $V_1$, $V_2$, $P_1$, $P_2$, $P_3$, $P_4$, $P_5$, $P_6$, $P_7$, $P_8$, $P_9$, $P_{11}$, $P_{12}$, $P_{13}$, $P_{14}$, $P_{15}$, $s_1$, $s_2$, $s_3$, $s_4$, $s_5$, $Q_2$, X, and $k_1$ are as described above.

In another preferred embodiment, $A_1$ represents a group derived from an electron-donating aromatic group, and $A_2$ represents a group derived from a dye acid, and the infrared radiation-absorbing compound is represented by the following Structure VIII:

VIII

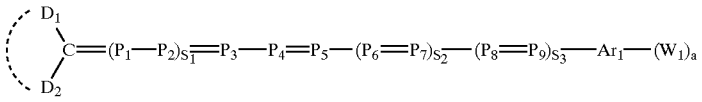

wherein $D_1$, $D_2$, $P_1$, $P_2$, $P_3$, $P_4$, $P_5$, $P_6$, $P_7$, $P_8$, $P_9$, $s_1$, $s_2$, $s_3$, $Ar_1$, $W_1$, and "a" are as described above.

In another preferred embodiment, $A_1$ represents a group derived from a heterocyclic group, and $A_2$ represents a group derived from a dye acid, and the infrared radiation-absorbing compound is represented by the following Structure IX:

IX

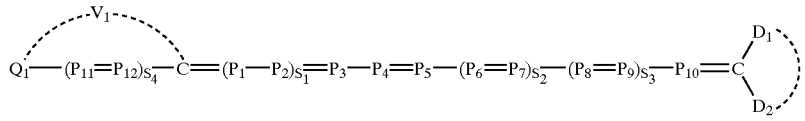

wherein $D_1$, $D_2$, $P_1$, $P_2$, $P_3$, $P_4$, $P_5$, $P_6$, $P_7$, $P_8$, $P_9$, $P_{10}$, $P_{11}$, $P_{12}$, $s_1$, $s_2$,$s_3$, $s_4$, $Q_1$, and $V_1$ are as described above.

In another preferred embodiment, $A_1$ represents a group derived from a heterocyclic group, and $A_2$ represents a group derived from an electron donating aromatic group, and the infrared radiation-absorbing compound is represented by the following Structure X:

X

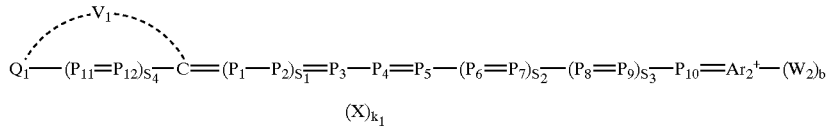

wherein $V_1$, $Q_1$, $P_1$, $P_2$, $P_3$, $P_4$, $P_5$, $P_6$, $P_7$, $P_8$, $P_9$, $P_{10}$, $P_{11}$, $P_{12}$, $s_1$, $s_2$, $s_3$,$s_4$, $Ar_2$, $W_2$, b, X and $k_1$ are as described above.

Representative $A_1$ and $A_2$ groups useful in this invention are exemplified below as Structures $A_1$-aa to $A_2$-yb. However, the invention is not considered to be limited only to these structures.

| $A_1$ | $A_2$ |
|---|---|
| 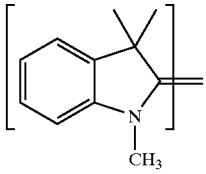 $A_1$-aa | 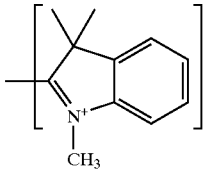 $A_2$-ab |
| 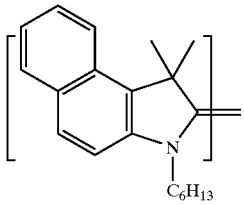 $A_1$-ba | 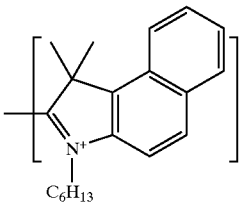 $A_2$-bb |
| 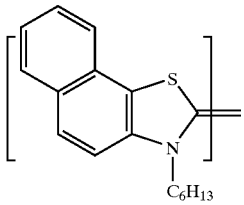 $A_1$-ca | 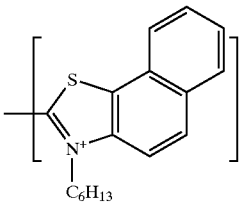 $A_2$-cb |

-continued

| $A_1$ | $A_2$ |
|---|---|
| 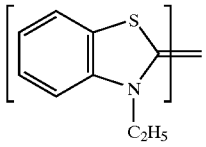 $A_1$-da | 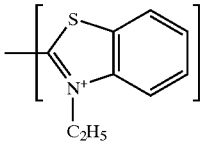 $A_2$-db |
| 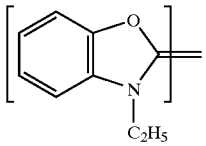 $A_1$-ea | 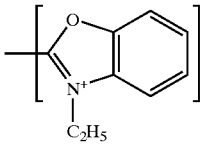 $A_2$-eb |
| 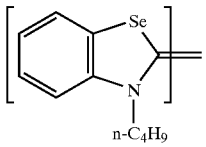 $A_1$-fa | 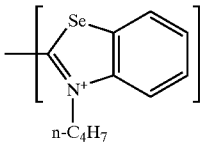 $A_2$-fb |
| 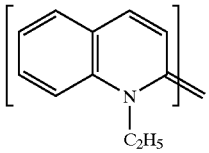 A1-ga | 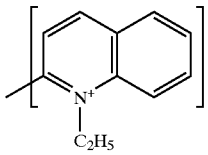 $A_2$-ga |

-continued
| $A_1$ | $A_2$ |
|---|---|
| 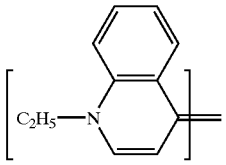 $A_1$-ha | 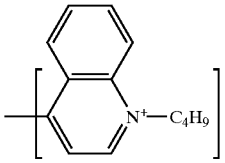 $A_2$-hb |
| 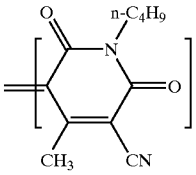 $A_2$-ib | 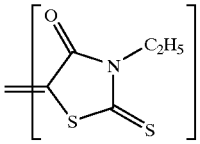 $A_2$-jb |
| | 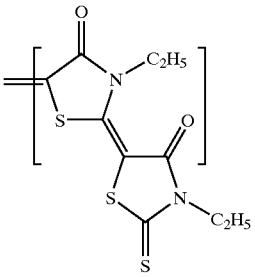 $A_2$-kb |
| 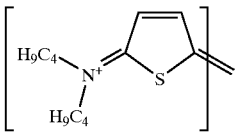 $A_1$-la | 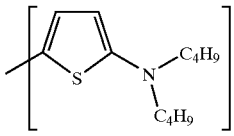 $A_2$-lb |
| 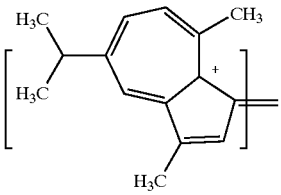 $A_1$-ma | 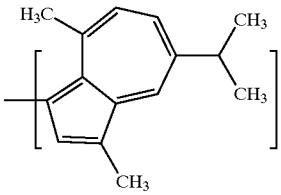 $A_2$-mb |
| 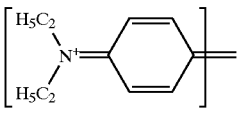 $A_1$-na | 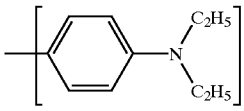 $A_2$-nb |
-continued
| $A_1$ | $A_2$ |
|---|---|
| 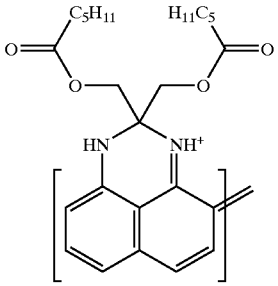 $A_1$-oa | 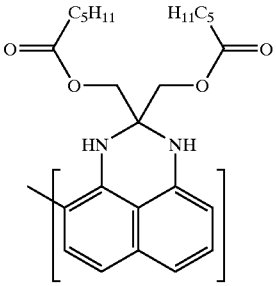 $A_2$-ob |
| 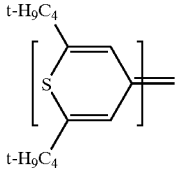 A1-pa | 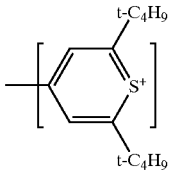 $A_2$-pb |
| 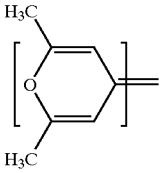 $A_1$-qa | 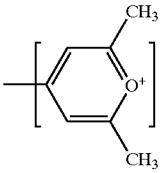 $A_2$-qb |
| 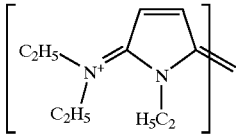 $A_1$-ra | 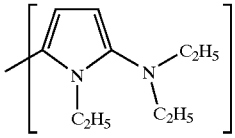 $A_2$-rb |
| 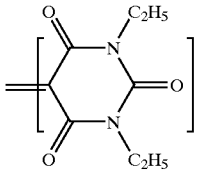 $A_2$-sb | 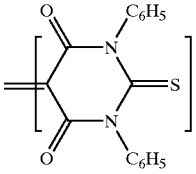 $A_2$-tb |
| 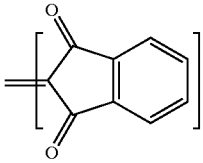 $A_2$-ub | 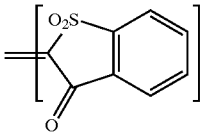 $A_2$-vb |

-continued

| $A_1$ | $A_2$ |
|---|---|
| 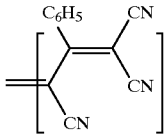 A2-wb | 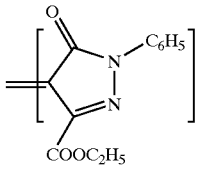 $A_2$-xb |
| 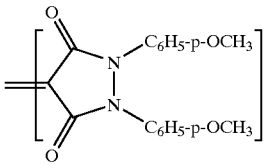 $A_2$-yb | |

Generally, each of those compounds has a $\lambda_{max}$ of 700 nm or greater. Preferably, these compounds absorb at a wavelength within the range of from about 700 to about 1400 nm, more preferably from about 700 to about 900 nm and even more preferably at from about 750 to about 850 nm. Most preferably, the $\lambda_{max}$ values of the infrared radiation-absorbing compounds are substantially the same as the wavelength of the radiation used to expose the photosensitive layer.

Representative infrared radiation-absorbing compounds useful in the practice of this invention include, but are not limited to Compounds IR-1 to IR-30 as shown below.

IR-1

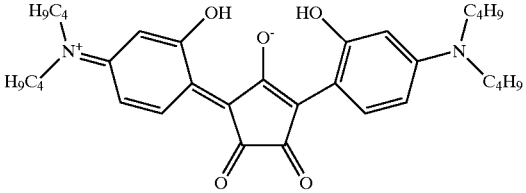

IR-2

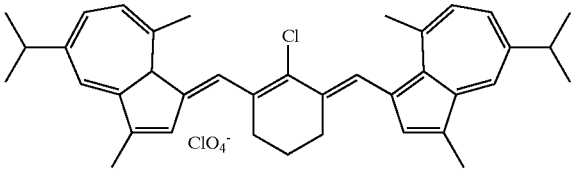

IR-3

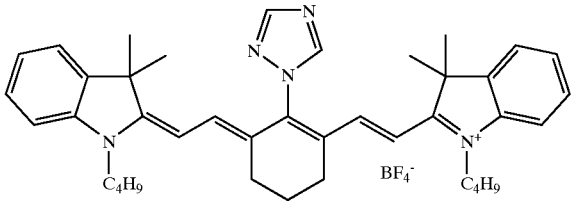

-continued

IR-4

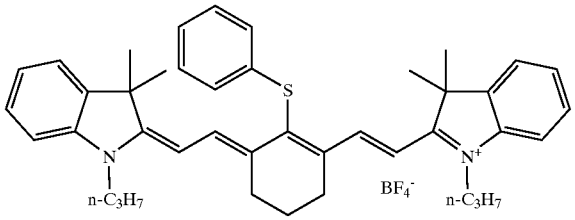

IR-5

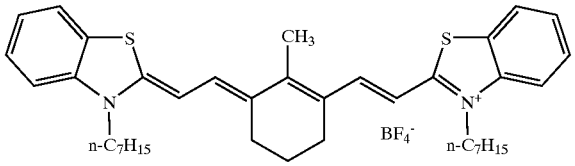

IR-6

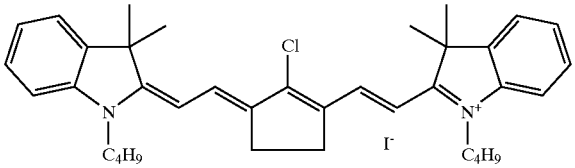

IR-7

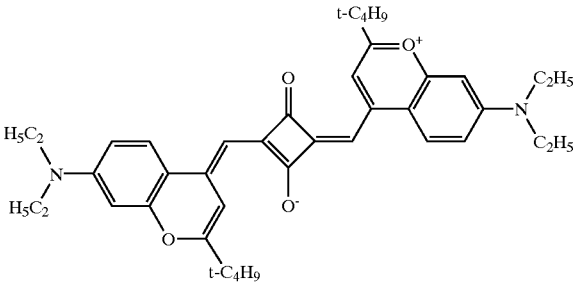

IR-8

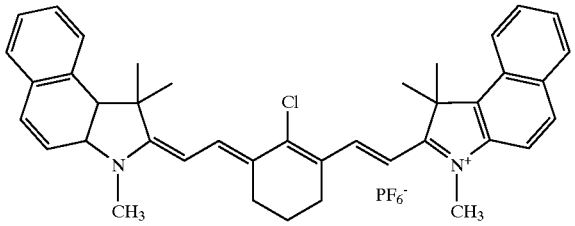

IR-9

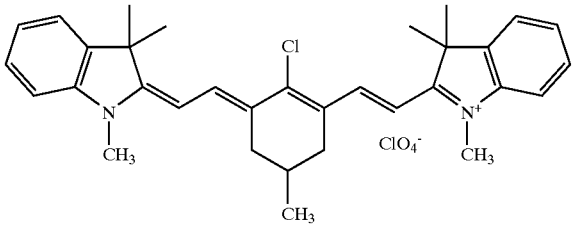

-continued
IR-10
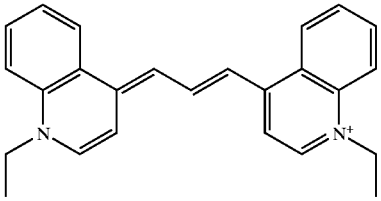
$1\text{-}C_2F_5—C_6F_{10}—SO_3^-$
$(PECHS^-)$
IR-11
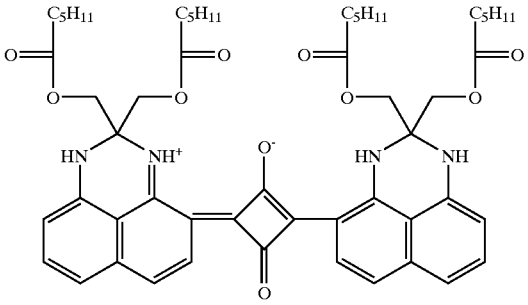
IR-12
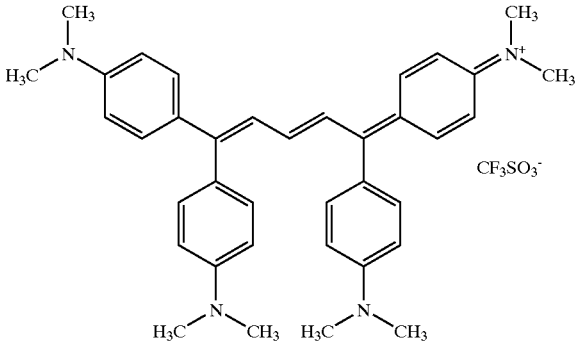
IR-13
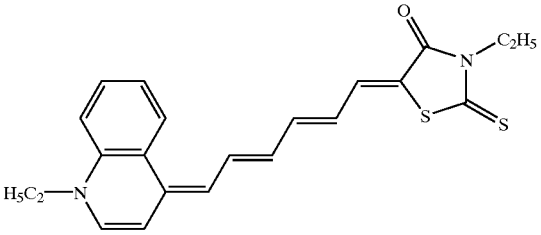
IR-14
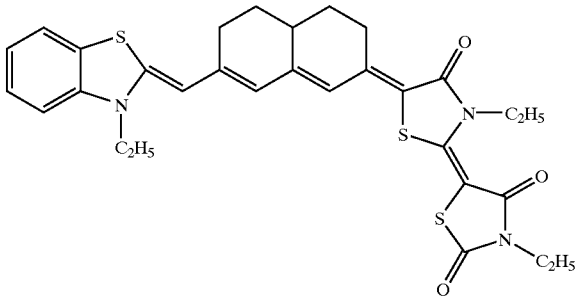
-continued
IR-15
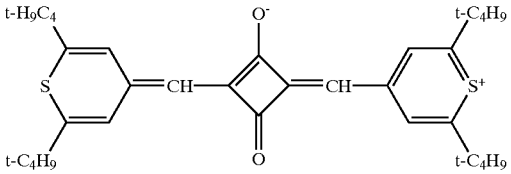
IR-16
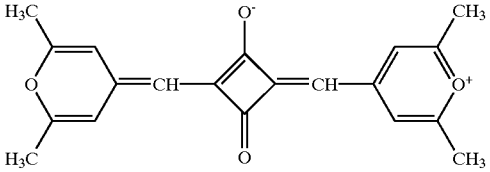
IR-17
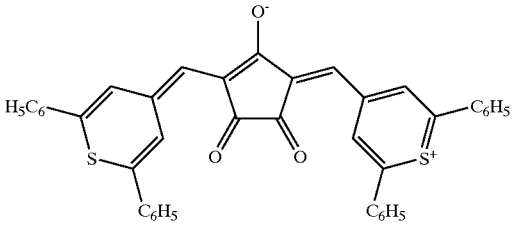
IR-18
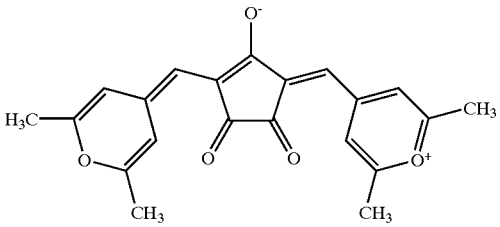
IR-19
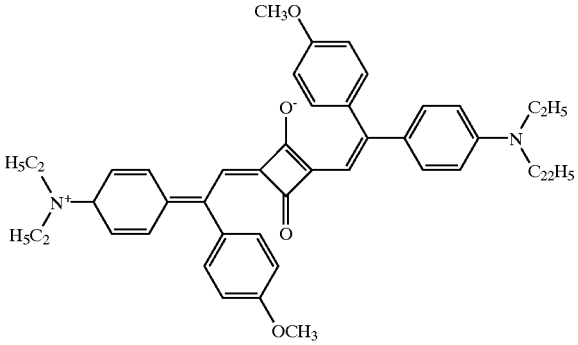
IR-20
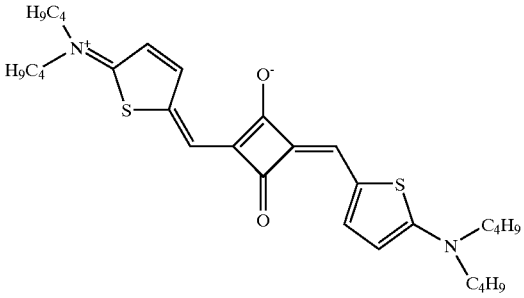

-continued

IR-21

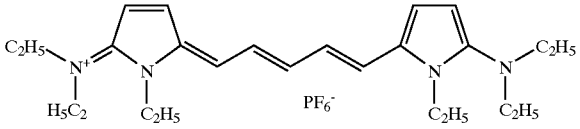

IR-22

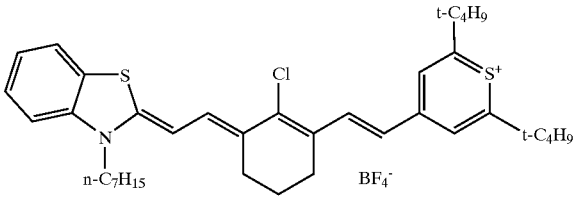

IR-23

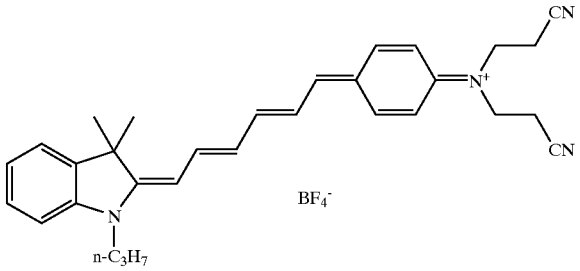

IR-24

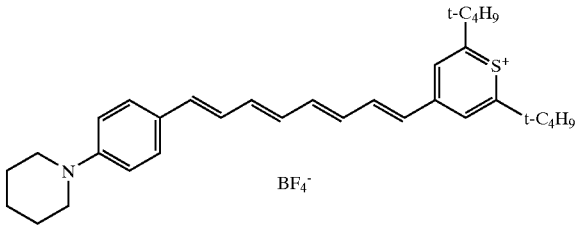

IR-25

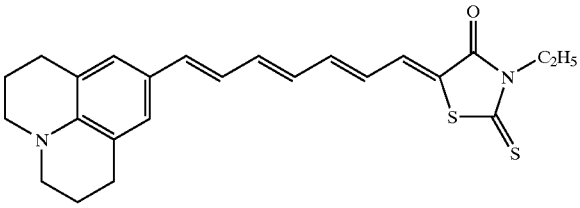

IR-26

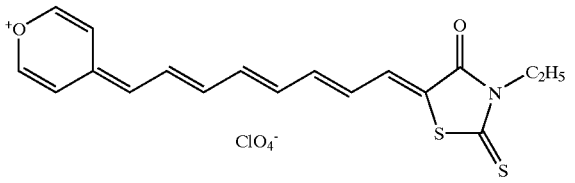

IR-27

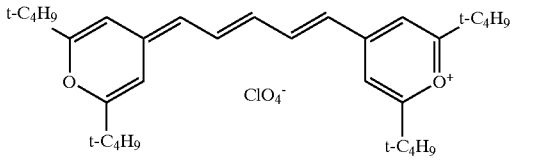

-continued

IR-28

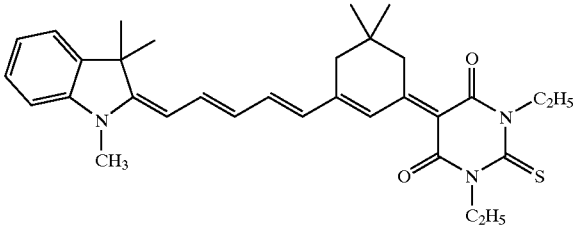

IR-29

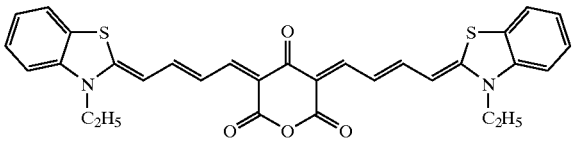

IR-30

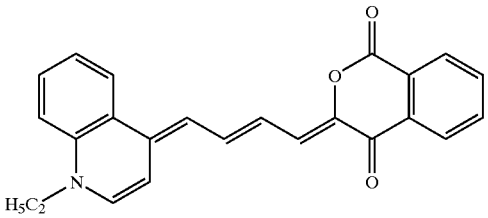

Mixtures of infrared radiation-absorbing compounds can be used if desired, including mixtures of one or more of compounds represented by any one of Structures II, III, IV, V, VI, VII, VIII, IX, or X noted above as well as mixtures of compounds represented by two or more of the noted Structures.

The infrared radiation-absorbing compounds useful in this invention can be prepared using known synthetic methods including those described in, for example, F. M. Hamer, *Cyanine Dyes and Related Compounds*, John Wiley & Sons, New York, 1964, K. Venkataraman, *The Chemistry of Synthetic Dyes*, Academic Press, New York, Volume II, Chapter XXXVIII, pp. 1143–1186, G. E. Ficken, *The Chemistry of Synthetic Dyes*, K. Venkataraman, Ed., Academic Press, New York, 1971, Volume IV, Chapter V, pp. 211–340, and references cited therein.

The second essential component of the heat-bleachable antihalation composition of this invention is a hexaarylbiimidazole (also known as a "HABI"), or mixtures thereof Such compounds are well known in the art, such as U.S. Pat. No. 4,196,002 (noted above), U.S. Pat. No. 5,652,091 (noted above), and U.S. Pat. No. 5,672,562 (noted above), all incorporated herein by reference. These compounds also known in the art as oxidative arylimidazolyl dimers including 2,4,5-triarylimidazolyl dimers comprising aryl groups that include p-isopropylphenyl, p-methoxyphenyl, p-n-butylphenyl, p-methylphenyl, and p-ethylphenyl.

Preferably, the hexaarylbiimidazole compounds are represented by the following Structure XI:

XI

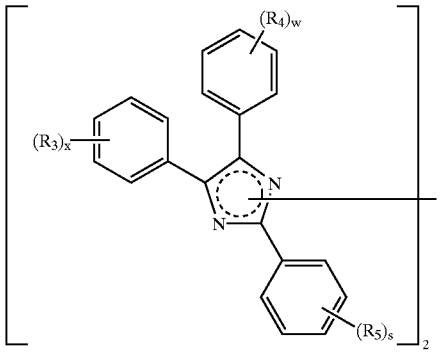

wherein $R_3$, $R_4$, and $R_5$ are independently substituted or unsubstituted alkyl groups having 1 to 10 carbon atoms (such as methyl, ethyl, iso-propyl, n-butyl, t-butyl, n-hexyl, hydroxymethyl, and benzyl) substituted or unsubstituted cycloalkyl groups having 5 to 10 carbon atoms forming the carbocyclic ring (such as cyclopentyl, cyclohexyl, p-methylcyclohexyl, and cycloheptyl), substituted or unsubstituted carbocyclic or heterocyclic aryl groups having 5 to 12 carbon and/or heteroatoms forming the ring (such as pyridyl, phenyl, tolyl, naphthyl, p-methoxyphenyl, o-carboxyphenyl, m-chlorophenyl, and furyl,), substituted or unsubstituted alkoxy groups having 1 to 10 carbon atoms (such as methoxy, 2-ethoxy, iso-propoxy, n-butoxy, methoxyethoxy, benzyloxy, and n-hexyloxy), substituted or unsubstituted aryloxy groups having 6 to 10 carbon atoms forming the ring (such as phenoxy, tolyloxy, naphthoxy, and p-chlorophenoxy), substituted or unsubstituted non-aromatic heterocyclyl groups (such as tetrahydrofuryl, tetrahydropyranyl, or piperidinyl), alkylthio, arylthio, cyano, sulfonamido, benzoyl, carbonyloxy (including carboxylic acids, and esters), and carbonylamido groups, or halo groups (such as fluoro, chloro, or bromo groups), and w, x, and s are independently 0, 1, 2, 3, 4, or 5.

Preferably, each of $R_3$, $R_4$, and $R_5$ is in the meta or para position on the respective phenyl rings. In addition, it is preferred that $R_3$, $R_4$, and $R_5$ are independently alkyl, alkoxy, aryl, aryloxy, alkylthio, arylthio, or halo groups, as defined above (both substituted and unsubstituted), and one or two of w, x, and s are independently 1 or 2.

More preferably, $R_3$, $R_4$, and $R_5$ are independently alkyl, alkoxy, or alkylthio groups as defined above (both substituted or unsubstituted). Most preferably, $R_3$, $R_4$, and $R_5$ are independently isopropyl, methoxy, or thiomethyl groups.

Representative hexaarylbiimidazole compounds useful in the practice of this invention include, but are not limited to, oxidative dimers formed from the following Compounds H-1 to H-27:

H-1

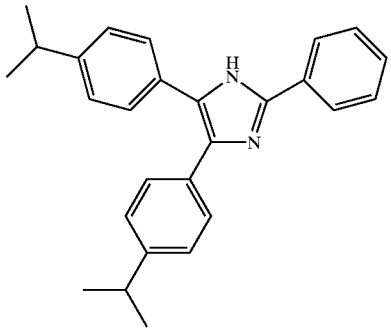

H-2

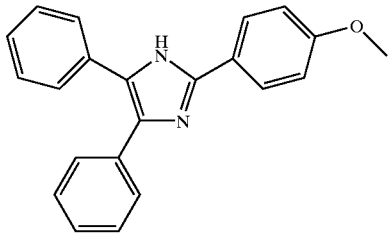

H-3

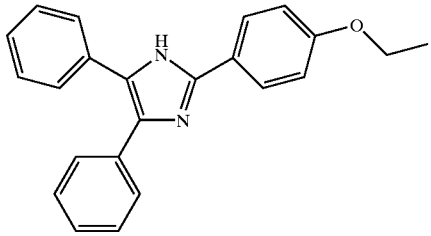

H-4

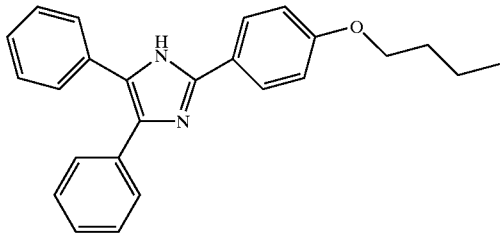

H-5

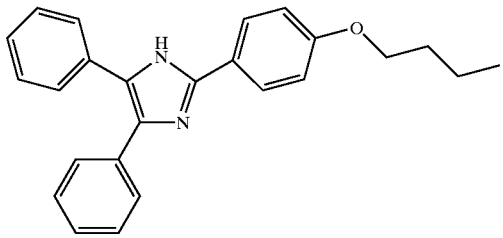

H-6

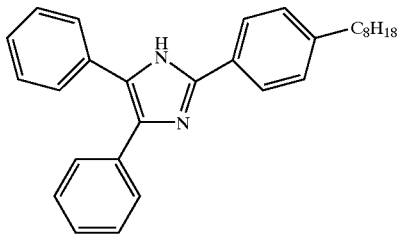

-continued
H-7
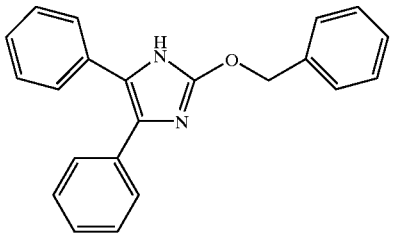
H-8
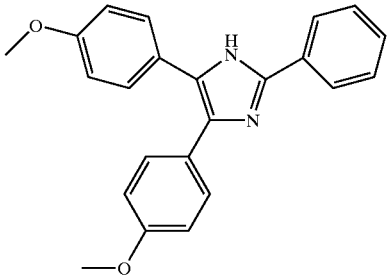
H-9
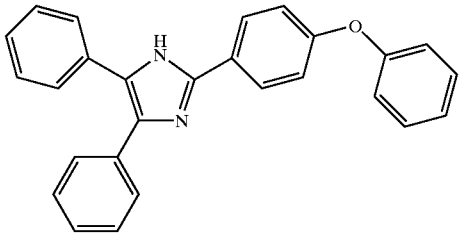
H-10
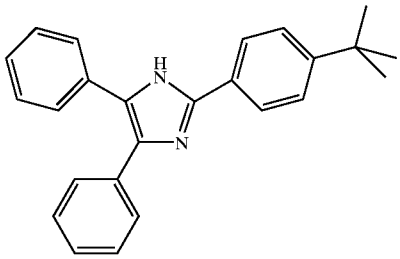
H-11
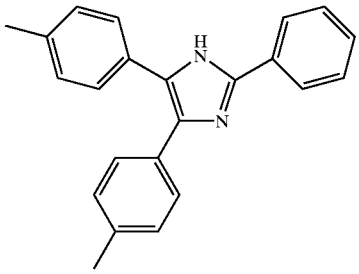
H-12
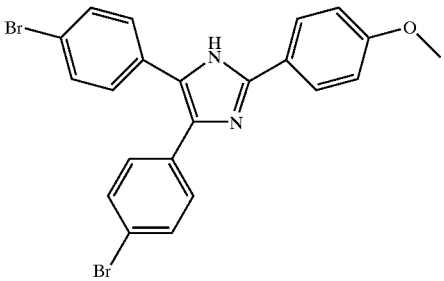
-continued
H-13
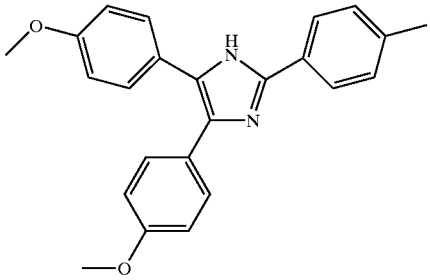
H-14
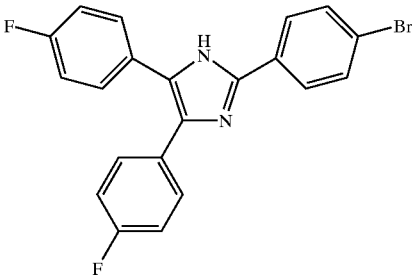
H-15
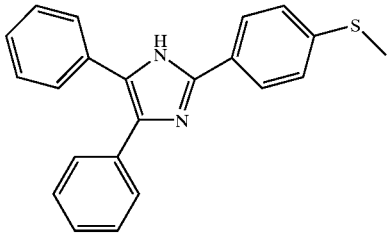
H-16
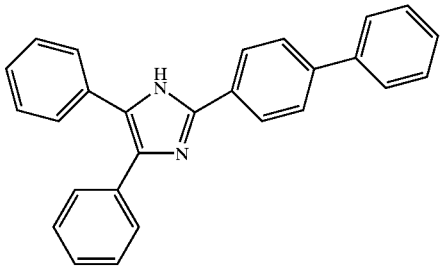
H-17
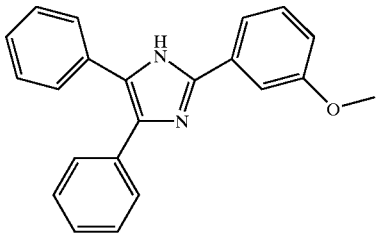
H-18
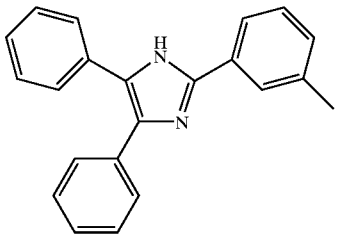

-continued

H-19

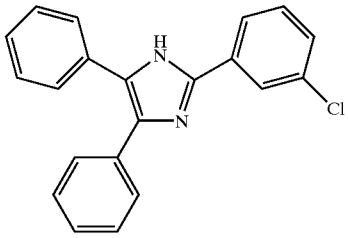

H-20

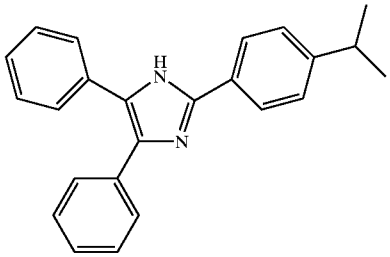

H-21

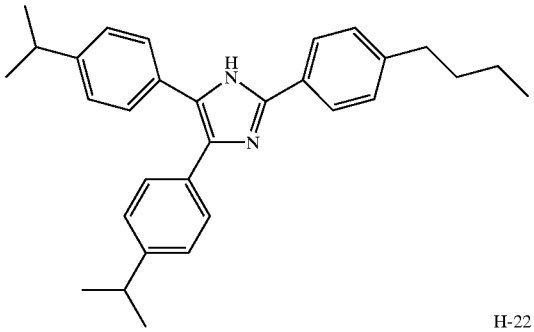

H-22

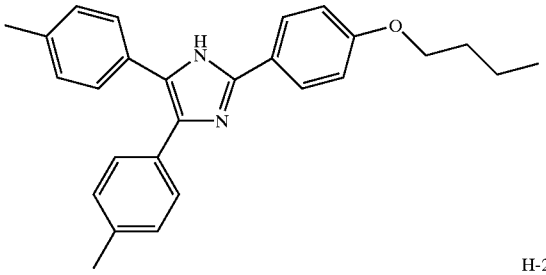

H-23

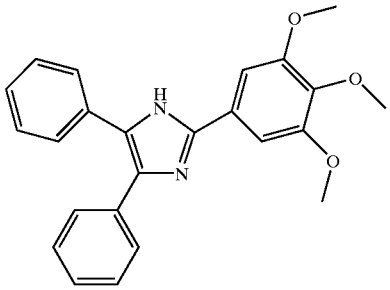

H-24

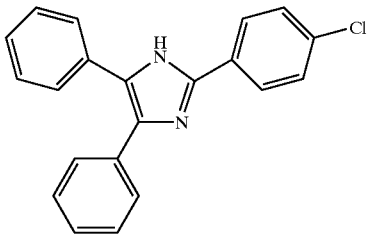

-continued

H-25

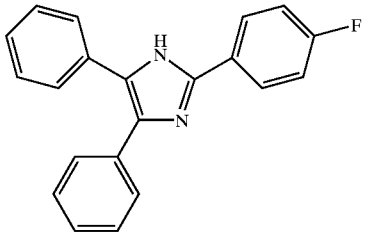

H-26

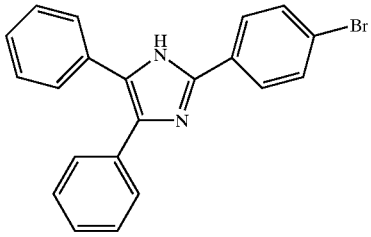

H-27

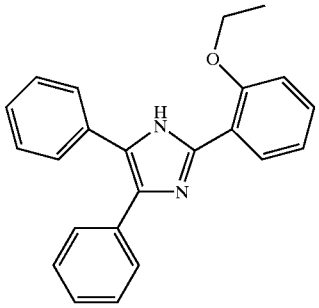

The HABI compounds can have a single chemical structure or they can exist as a mixture of isomers. A single triarylimidazole can conceivably give rise to different structural dimers if the dimer linkage is made via C—N, C—C, or N—N bonds. These individual structural dimers or mixtures thereof can be generated chemically, thermally, or photolytically from a common triarylimidazole radical. While the dimers specifically shown herein are linked via a C—C and C—N bonds, the present invention is not to be so limited. For example, for Compound H-1 noted above, typical non-limiting examples of its oxidative dimers include compounds H-1A, H-1B and H-1C shown below:

H-1A

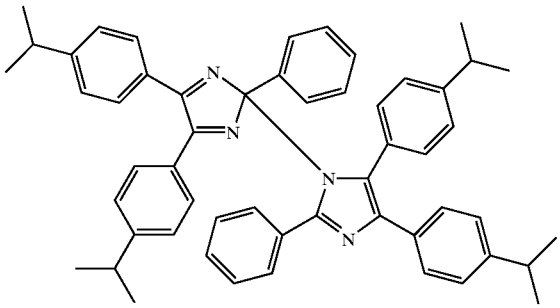

-continued

H-1B

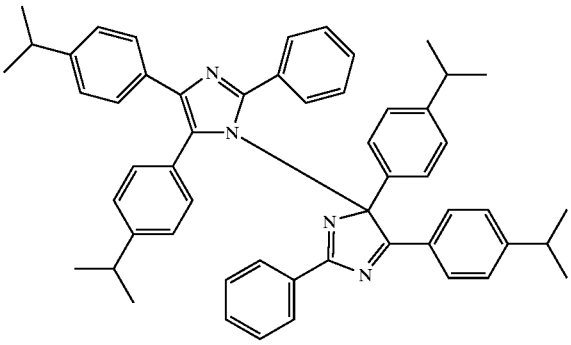

H-1C

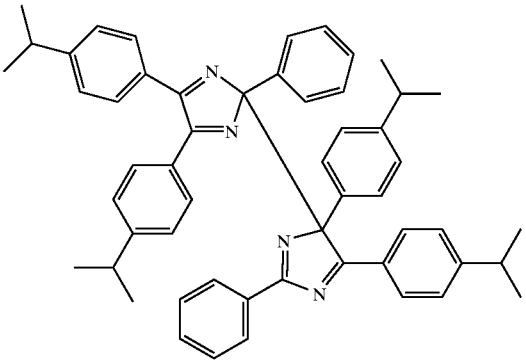

Further details of such compounds are provided by Tanino et al., *Bull. Chem. Soc. Jpn,* 45, 1474–80 (1972), Lang et al., *J. Electroanal. Chem.* 78, 133–143 (1977), Baumgartel et al., *Z. Naturforsch.,* 18b, 406- (1963), and White et al., *J. Amer. Chem. Soc.* 88, 3825- (1966), as well as the Levinson et al., Perry et al., and Goswami et al. patents noted above.

The hexaarylbiimidazoles can be readily prepared using known preparatory methods that include interfacial oxidation of the parent triarylimidazole using potassium ferricyanide. Further details are provided, for example in U.S. Pat. No. 4,196,002 (noted above), U.S. Pat. No. 4,201,590 (noted above), Hayashi et al., *Bull. Chem. Soc. Jpn,* 33, 565 (1960), and U.S. Pat. No. 4,866,183 (Kempe et al.), all incorporated herein by reference.

The amount of one or more infrared radiation-absorbing compounds present in the heat-bleachable antihalation compositions of this invention is generally at least 0.01, and preferably from about 0.1 to about 5 weight %, based on total dry formulation weight. The amount of one or more hexaarylbiimidazoles in the same composition is generally at least 0.05 and preferably from about 0.1 to about 10 weight %, based on total formulation weight.

In addition, the molar ratio of the one or more hexaarylbiimidazoles to the one or more infrared radiation-absorbing compounds is generally from about 1:1 to about 100:1, and preferably from about 1:1 to about 4:1.

Based on conventional coating techniques and coverage, the resulting dry coated amount of infrared radiation-absorbing compound is generally sufficient to provide an optical density of at least 0.1, and preferably an optical density of from about 0.3 to about 1.5. The dry coated amounts ($g/m^2$) will vary depending upon the absorptivity of the particular infrared radiation absorbing compounds but is generally at least $5\times10^{-7}$ $mol/m^2$. The amount of dry coated HABI is generally at least $5\times10^{-7}$ $mol/m^2$.

In most instances, the heat-bleachable antihalation compositions of this invention include one or more film-forming binders. These materials also must have a cumulative glass transition temperature of from about 30 to about 200° C. (preferably from about 50° C. to about 150° C.). Glass transition temperatures are well known parameters that can be measured using techniques and instruments known to polymer chemists.

Particularly useful binders include various homopolymers and copolymers that include, but are not limited to, polystyrenes (including polymers of styrene derivatives), polyacrylates, polymethacrylates, polycarbonates, cellulose esters, polyvinyl acetals (such as polyvinyl butyral), polysulfonamides, polyvinyl halides, polyvinylidene halides, polyvinyl acetate, butadiene polymer, polyesters, ethylene-vinyl acetate copolymers, polyvinyl alcohols, and gelatin. Particularly useful binders include polyvinyl butyral and cellulose esters. The binders generally comprise at least 70 weight % of the heat-bleachable antihalation composition, based on total formulation weight.

The methods of coating these heat-bleachable compositions are not critical. They may be coated by various coating procedures including wire wound rod coating, dip coating, air knife coating, curtain coating, slide coating, or extrusion coating. They may be coated from aqueous solutions, aqueous dispersions, organic solutions, or organic dispersions. It is preferable to coat these materials from organic solutions.

The compositions generally include one or more polar organic solvents including, but not limited to, ketones (such as acetone, methyl isobutyl ketone, cyclohexanone, and methyl ethyl ketone), esters (such as ethyl acetate), lower alcohols (such as methanol, ethanol and isobutanol), chlorinated solvents (such as methylene chloride, trichloromethane, and tetrachloroethylene), N,N-dimethylformamide, toluene, tetrahydrofuran, dimethyl sulfoxide, acetonitrile, and mixtures thereof.

The heat-bleachable antihalation compositions can also include a variety of other addenda generally used in antihalation layers of photothermographic materials including, but not limited to, stabilizers (or stabilizer precursors), brighteners, antifoggants, hardeners, plasticizers, lubricants, antistatic agents (conductive agents), coating aids, surfactants, melt formers, colorants, particulates (such as anti-slip agents and matte agents), non-beat bleachable antihalation dyes, and anti-fading agents.

Imaging/Development

While the imaging materials of the present invention can be imaged in any suitable manner consistent with the type of material using any suitable imaging source (typically some type of radiation or electronic signal), the following discussion will be directed to the preferred imaging means. Generally, the materials are sensitive to radiation in the range of from about at least 700 nm to about 1400 nm, and preferably from about 750 nm to about 850 nm.

Imaging can be achieved by exposing the photothermographic materials to a suitable source of infrared radiation to which they are sensitive, to provide a latent image. Suitable exposure means are well known and include any source of infrared radiation, including: an infrared laser, an infrared laser diode, an infrared light-emitting diode, an infrared lamp, or any other infrared radiation source readily apparent to one skilled in the art, and others described in the art, such as in *Research Disclosure*, September, 1996, item 38957. (Particularly useful exposure means include laser diodes, including laser diodes that are modulated to increase imaging efficiency using what is known as multilongitudinal exposure techniques as described in U.S. Pat. No. 5,780,207

(Mohapatra et al.). Other exposure techniques are described in U.S. Pat. No. 5,493,327 (McCallum et al.).

Thermal development conditions will vary, depending on the construction used but will typically involve heating the imagewise exposed material at a suitably elevated temperature. Thus, the latent image can be developed by heating the exposed material at a moderately elevated temperature of, for example, from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means such as a hot plate, a steam iron, a hot roller or a heating bath.

In some methods, the development is carried out in two steps. Thermal development takes place at a higher temperature for a shorter time (for example at about 150° C. for up to 10 seconds), followed by thermal diffusion at a lower temperature (for example at about 80° C.) in the presence of a transfer solvent.

Use as a Photomask

The photothermographic materials of the present invention are sufficiently transmissive in the range of from about 350 to about 450 nm in non-imaged areas to allow their use in a method where there is a subsequent exposure of an ultraviolet or short wavelength visible radiation sensitive imageable medium. For example, imaging the photothermographic material and subsequent development affords a visible image. The heat-developed photothermographic material absorbs ultraviolet or short wavelength visible radiation in the areas where there is a visible image and transmits ultraviolet or short wavelength visible radiation where there is no visible image. The heat-developed material may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the exposed and heat-developed photothermographic material provides an image in the imageable material. This method is particularly useful where the imageable medium comprises a printing plate and the photothermographic material serves as an imagesetting film.

The present invention also provides a method for the formation of a visible image (usually a black-and-white image) by first exposing to infrared electromagnetic radiation and thereafter heating the inventive photothermographic material. In one embodiment, the present invention provides a method comprising:

A) imagewise exposing the photothermographic material of this invention to infrared electromagnetic radiation to which the photocatalyst (for example, a photosensitive silver halide) of the material is sensitive, to generate a latent image, and B) simultaneously or sequentially, heating the exposed material to develop the latent image into a visible image.

The photothermographic material may be exposed in step A using any source of infrared radiation, including: an infrared laser, an infrared laser diode, an infrared light-emitting diode, an infrared lamp, or any other infrared radiation source readily apparent to one skilled in the art.

This visible image can also be used as a mask for exposure of other photosensitive imageable materials, such as graphic arts films, proofing films, printing plates and circuit board films, that are sensitive to suitable imaging radiation (for example, UV radiation). This can be done by imaging an imageable material (such as a photopolymer, a diazo material, a photoresist, or a photosensitive printing plate) through the exposed and heat-developed photothermographic material. Thus, in some other embodiments wherein the photothermographic material comprises a transparent support, the image-forming method further comprises:

C) positioning the exposed and heat-developed photothermographic material between a source of imaging radiation and an imageable material that is sensitive to the imaging radiation, and D) exposing the imageable material to the imaging radiation through the visible image in the exposed and heat-developed photothermographic material to provide an image in the imageable material.

The following examples are provided to illustrate the practice of this invention, and are not intended to be limiting in any manner. The examples provide exemplary synthetic procedures and preparatory procedures using the combination of hexaarylbiimidazole and an infrared radiation-absorbing compounds within the scope of the present invention.

Materials and Methods for the Examples

All materials used in the following examples are readily available from standard commercial sources, such as Aldrich Chemical Co. (Milwaukee Wis.) unless otherwise specified. All percentages are by weight unless otherwise indicated. The following additional terms and materials were used.

ACRYLOID™ A-21 is an acrylic copolymer available from Rohm and Haas (Philadelphia, Pa.).

BUTVAR® B-79 is a polyvinyl butyral resin available from Solutia, Inc. (St. Louis, Mo.).

CAB 171-15S is a cellulose acetate butyrate resin available from Eastman Chemical Co (Kingsport, Tenn.).

CCBA is 4-chlorobenzoyl benzoic acid

DESMODUR® N3300 is an aliphatic hexamethylene diisocyanate available from Bayer Chemicals (Pittsburgh, Pa.).

L-9342 is a perfluorinated organic antistatic agent described in U.S. Pat. No. 4,975,363 (Cavallo et al.).

PERMANAX WSO (or NONOX) is 1,1-bis(2-hydroxy-3,5-dimethylphenyl)-3,5,5-trimethylhexane [CAS RN=7292-14-0] and is available from St-Jean PhotoChemicals, Inc. (Quebec, Canada).

MEK is methyl ethyl ketone (or 2-butanone).

"2-MBO" is 2-mercaptobenzoxazole (Aldrich Chemical Co.)

MMBI is 5-Methyl-2-mercaptobenzimidazole

4-MPA is 4-methylphthalic acid

"PHP" is pyridinium hydrobromide perbromide.

Vitel 2200 is a polyester resin (Bostik, Inc., Middleton, Mass.).

GASIL 23F is a synthetic amorphous silicon dioxide (Crosfield Chemicals, Joliet Ill.).

SMA-8 Beads are 8 $\mu$m polymeric styryl methacrylate hexanediol diacrylate beads available from 3M Company, (St. Paul, Minn.).

Sensitizing Dye A is

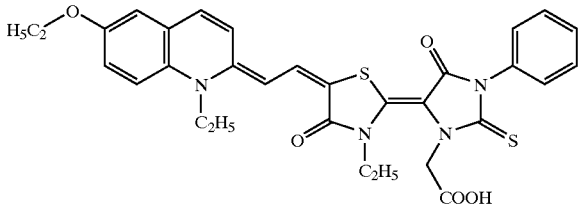

TCPA is tetrachlorophthalic acid

Vinyl Sulfone-1 (VS-1) is described in U.S. Pat. No. 6,143,487 and has the following structure:

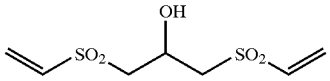

Antifoggant A is 2-(tribromomethylsulfonyl)quinoline and has the following structure:

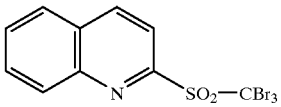

Antifoggant B is described in U.S. Pat. No. 5,686,228 and has the following structure:

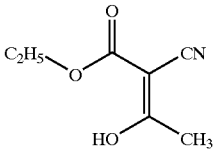

In the following examples, unless otherwise noted, all percentages are given by weight. Absorbance was measured on a conventional visible spectrophotometer at the given wavelength in optical density units. Color scale L a*b* values were measured using the conventional CIE (Commission Internationale de l'Eclairage) lab color scale. The a* value is a measure of redness (positive a*), and the b* value is a measure of yellowness (positive b*). The "L" value represents the degree of darkness (an L of 100 is totally non-absorbing and an L of 0 is totally absorbing).

The following examples are provided to illustrate the practice of the present invention and the invention is not meant to be limited thereby.

EXAMPLES 1–20

Preparation of Antihalation Compositions

Coating solutions were prepared by mixing: 4.21 g of methyl ethyl ketone (MEK), 5.62 g of BUTVAR® B-79, 0.11 g of L-9342 antistat, the amounts of infrared radiation-absorbing compound and of HABI derived from triarylimidazole H-1 shown in TABLE I. Each solution was coated onto 4 mil (102 $\mu$l m) thick polyethylene terephthalate film using a #60 wire-wound bar, and dried in an oven at 71 ° C. for 1 minute to give the antihalation coating. The initial absorbance ("Initial A") of each film was recorded at the wavelength of maximum absorbance ($\lambda_{max}$).

The films were then thermally processed using a Dry-View™ Model 2771 processor at 120° C. for 20 seconds. The absorbance after bleaching ("After A") at $\lambda_{max}$ was again measured and the amount of change in Absorbance recorded as "% Bleach". These data, shown below in TABLE I, demonstrate that the absorbance is significantly reduced after thermal processing. It should also be noted that, if necessary, the amount of bleaching may be adjusted by varying the amount of HABI used.

Additional samples of coated films were also stored in the dark at room temperature (19–23° C.) for 3 months. The absorbance of each sample as well as their L a*b* color values was measured before and after thermal processing. These L a*b* values, shown below in TABLE II, demonstrate that the inventive compositions retained their initial absorbance during aging and still bleached. Typically shifts in the hue of these compositions are observed after bleaching as shown in the changes in the a* and b* values.

TABLE I

| Example | Dye (mg) | HABI H-1 (mg) | $\lambda_{max}$ (nm) | Initial A | After A | % Bleach |
|---|---|---|---|---|---|---|
| 1 | IR-1 (14) | 58 | 832 | 1.236 | 0.881 | 28.7 |
| 2 | IR-1 (14) | 174 | 832 | 0.907 | 0 | 100 |
| 3 | IR-2 (14) | 50 | 928 | 0.274 | 0.002 | 99.1 |
| 4 | IR-3 (14) | 46 | 800 | 1.465 | 0.404 | 72.4 |
| 5 | IR-4 (14) | 45 | 806 | 1.393 | 0.177 | 87.3 |
| 6 | IR-5 (14) | 46 | 806 | 0.698 | 0.007 | 98.9 |
| 7 | IR-6 (14) | 47 | 820 | 1.368 | 0.148 | 89.2 |
| 8 | IR-7 (14) | 51 | 808 | 2.056 | 0.360 | 82.5 |
| 9 | IR-8 (14) | 44 | 828 | 0.952 | 0.225 | 76.3 |
| 10 | IR-9 (7) | 27 | 790 | 0.797 | 0.174 | 78.1 |
| 11 | IR-10 (14) | 55 | 718 | 0.476 | 0.005 | 98.9 |
| 12 | IR-27 (14) | 58 | 708 | 1.601 | 0.583 | 63.6 |
| 13 | IR-12 (14) | 46 | 816 | 0.792 | 0.655 | 17.2 |
| 14 | IR-12 (14) | 92 | 816 | 0.792 | 0.544 | 31.4 |
| 15 | IR-12 (14) | 138 | 816 | 0.812 | 0.458 | 43.6 |
| 16 | IR-12 (14) | 180 | 816 | 0.803 | 0.401 | 50.0 |
| 17 | IR-11 (14) | 34 | 804 | 0.646 | 0.231 | 64.2 |
| 18 | IR-28 (14) | 60 | 712 | 0.497 | 0.037 | 93.0 |
| 19 | IR-29 (14) | 57 | 708 | 0.616 | 0.068 | 89.0 |
| 20 | IR-30 (14) | 86 | 702 | 0.196 | 0.004 | 98.0 |

TABLE II

| Example | Initial A after aging | After A after aging | L | a* | b* | L | a* | b* |
|---|---|---|---|---|---|---|---|---|
| | | | Before processing | | | After processing | | |
| 1 | 1.199 | 0.881 | 93.27 | 0.40 | 5.70 | 93.44 | −0.13 | 4.37 |
| 2 | 0.882 | 0 | 93.59 | −0.68 | 5.64 | 94.42 | −1.23 | 5.52 |
| 3 | 0.224 | 0.002 | 93.64 | 0.07 | 4.23 | 95.00 | −0.89 | 4.31 |
| 4 | 1.373 | 0.404 | 87.72 | −10.35 | −9.12 | 93.74 | −2.17 | 4.84 |
| 5 | 1.204 | 0.176 | 94.39 | −2.54 | 3.82 | 93.54 | −2.17 | 4.84 |
| 6 | 0.586 | 0.007 | 93.72 | −0.36 | 3.20 | 94.39 | −2.54 | 3.82 |
| 7 | 1.23 | 0.147 | 86.73 | −15.16 | −11.6 | 89.30 | −4.75 | −0.24 |

TABLE II-continued

| Example | Initial A after aging | After A after aging | L | a* | b* | L | a* | b* |
|---|---|---|---|---|---|---|---|---|
| | | | Before processing | | | After processing | | |
| 8 | 1.742 | 0.360 | 94.54 | −4.98 | 2.35 | 91.88 | 2.90 | 2.88 |
| 9 | 1.059 | 0.225 | 94.89 | −3.20 | 4.11 | 93.40 | −1.00 | 6.08 |
| 12 | 1.423 | 0.543 | 92.23 | −12.63 | −4.04 | 93.80 | −3.30 | 0.27 |
| 13 | 0.823 | 0.665 | 86.42 | −15.31 | −11.35 | 85.03 | −10.89 | −11.08 |
| 14 | 0.811 | 0.543 | 86.86 | −15.04 | −11.09 | 85.77 | −10.47 | −10.90 |
| 15 | 0.806 | 0.458 | 86.72 | −15.21 | −10.92 | 85.42 | −9.60 | −10.15 |
| 16 | 0.766 | 0.401 | 87.27 | −14.11 | −9.71 | 86.28 | −8.71 | −8.51 |
| 17 | 0.544 | 0.231 | 95.03 | −0.82 | 2.71 | 94.16 | −1.01 | 2.68 |

EXAMPLES 21 AND 22

Coating solutions were prepared by mixing: 4.21 g of methyl ethyl ketone (MEK), 5.62 g of BUTVAR™ B-79, 0.11 g of L-9342, 7 mg of infrared absorbing dye IR-9, and the amount of the HABI derived from indicated triarylimidazole. Each solution was coated onto 4 mil (102 $\mu$m) thick polyethylene terephtbalate film using a #60 wire-wound bar, and dried in an oven at 71° C. for 1 minute to give the antihalation coating. The initial absorbance ("initial A") of each film was recorded at the wavelength of maximum absorbance ($\lambda_{max}$)

The films were then thermally processed using a DryView™ Model 2771 processor at 120° C. for 20 seconds. The absorbance after bleaching ("after A") at $\lambda_{max}$ was again measured and the change in Absorbance recorded as the "% Bleach". These data, shown below in TABLE III, demonstrate that the Absorbance is significantly reduced after thermal processing.

Additional samples of coated films were also stored in the dark at room temperature (19–23° C.) for 3 months. The absorbance of each sample as well as their L a*b* color values was again measured, both before and after thermal processing. These L a*b* color values, shown below in TABLE IV demonstrate that the inventive compositions retained their initial absorbances during aging and still bleached. The changes in a* and b* values demonstrate the shift in the hue of these compositions that occurs during bleaching.

TABLE III

| Example | HABI (mg) | $\lambda_{max}$ (nm) | Initial A | After A | % Bleach |
|---|---|---|---|---|---|
| 21 | H-9 (27) | 788 | 0.650 | 0.265 | 59.2 |
| 22 | H-15 (24) | 788 | 0.473 | 0.056 | 88.2 |

TABLE IV

| Example | Initial A after aging | After A after aging | L | a* | b* | L | a* | b* |
|---|---|---|---|---|---|---|---|---|
| | | | Before processing | | | After processing | | |
| 21 | 0.419 | 0.058 | 95.02 | −2.49 | 2.90 | 95.39 | −0.45 | 2.63 |
| 22 | 0.612 | 0.265 | 94.95 | 3.23 | 1.95 | 95.26 | −1.22 | 2.61 |

EXAMPLE 23

Preparation of Photothermographic Material

Antihalation Formulation

An antihalation composition of this invention was prepared as in Example 1 except that 23 mg of the HABI derived from H-1 and 7 mg of dye IR-4 were used. This antihalation formulation was coated on the backside of a 4 mil (102 $\mu$m) polyethylene terephthalate support that had been previously coated with a photothermographic emulsion formulation and topcoat formulation prepared as follows.

Photothermographic Emulsion Formulation

A preformed silver halide, silver carboxylate "soap" was prepared as described in U.S. Pat. No. 5,382,504. The average silver halide grain size was 0.12 $\mu$m. The photothermographic emulsion was prepared from the soap dispersion in a manner similar to that described in U.S. Pat. No. 6,083,681 (noted above) but using the materials and amounts shown below.

To 207.28 parts of silver soap homogenate (26% solids) were added in order:

| | |
|---|---|
| MEK | 5.74 parts |
| Pyridinium hydrobromide perbromide | 0.24 parts in |
| | 1.35 parts methanol |
| Zinc bromide | 0.23 parts in |
| | 1.85 parts methanol |
| Sensitizer Dye Premix Solution | |
| Sensitizer dye S-1 | 0.007 parts |
| MMBI | 0.15 parts |
| CBBA | 1.66 parts |
| Methanol | 10.80 parts |
| MEK | 3.77 parts |
| Pioloform BL-16 | 41.01 parts |
| Antifoggant Premix | |
| 1.29 parts Antifoggant A | 1.29 parts |
| TCPA | 0.37 parts |
| 4-MPA | 0.60 parts |
| MEK | 11.42 parts |
| Methanol | 0.36 parts |
| Lowinox 421B46 | 9.48 parts |
| DBSMODUR N3300 | 0.66 parts in |
| | 0.33 parts MEK |
| Phthalazine | 1.32 parts |

Protective Topcoat Formulation

A protective topcoat for the photothermographic emulsion layer was prepared as follows:

| | |
|---|---|
| MEK | 92.5 parts |
| Acryloid A21 | 0.26 parts |
| CAB 171-15S | 6.66 parts |
| Vinyl Sulfone (VS-1) | 0.19 parts |
| Benzotriazole | 0.14 parts |
| Dye IR 11 | 0.12 parts |
| Antifoggant B | 0.13 parts |

The resulting photothermographic material was imagewise exposed using an 810 nm laser diode and heat-developed in a DryView™ Model 2771 processor at 120° C. for 20 seconds to provide a black-and-white image exhibiting no halation. Before thermal processing, the antihalation layer had an absorbance of 0.878 at 808 nm. After thermal processing, the absorbance of the antihalation layer had decreased to 0.271 at 808 nm.

The invention has been described in detail with particular reference to certain preferred embodiments thereof, but it will be understood that variations and modifications can be effected within the spirit and scope of the invention.

We claim:

1. A heat-bleachable antihalation composition comprising:

a) a hexaarylbiimidazole, and b) an infrared radiation-absorbing compound having the following Structure I:

$$A_1—L_1—A_2 \quad (I)$$

wherein $A_1$ represents a group derived from a dye base, a heterocyclic group, or an electron-donating aromatic group, $A_2$ represents a group derived from a dye base, a heterocyclic group, a group derived from a dye acid, or an electron-donating aromatic group, and $L_1$ represents a conjugated linking group that maintains electron delocalizaton between $A_1$ and $A_2$ to provide infrared absorbance.

2. The antihalation composition of claim 1 wherein said infrared radiation-absorbing compound is represented by the following Structure II:

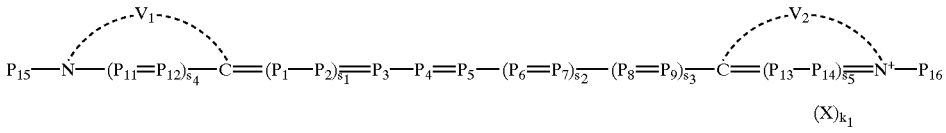

(II)

wherein $V_1$ and $V_2$ independently represent groups of atoms necessary to form 5-, 6-, or 7-membered heterocyclic rings, which rings may be further fused to additional carbocyclic or heterocyclic rings, $P_1$, $P_2$, $P_3$, $P_4$, $P_5$, $P_6$, $P_7$, $P_8$, $P_9$, $P_{11}$, $P_{12}$, $P_{13}$, and $P_{14}$ independently represent methine groups or substituted methine groups that optionally may form rings with one or more other methine groups or with an auxochrome, $P_{15}$ and $P_{16}$ are independently alkyl, aryl, alkaryl, or heterocycl groups, $s_1$, $s_2$, $s_3$, $s_4$, and $s_5$ are independently equal to 0 or 1, X is an electric charge neutralizing counterion, and $k_1$ is an integer inclusive of 0 necessary to neutralize an electric charge in the molecule.

3. The antihalation composition of claim 1 wherein said infrared radiation-absorbing compound is a compound that is represented by the following Structure III:

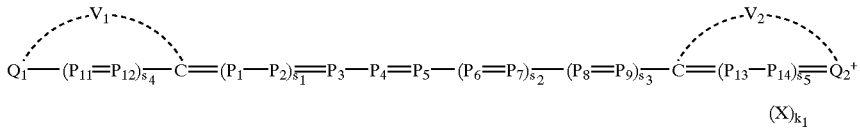

(III)

wherein $Q_1$ and $Q_2$ independently represent heteroatoms, $V_1$ and $V_2$ independently represent groups of atoms necessary to form 5-, 6-, or 7-membered heterocyclic rings, which rings may be further fused to additional carbocyclic or heterocyclic rings, $P_1$, $P_2$, $P_3$, $P_4$, $P_5$, $P_6$, $P_7$, $P_8$, $P_9$, $P_{11}$, $P_{12}$, $P_{13}$, and $P_{14}$ independently represent methine groups or a substituted methine groups that optionally may form a ring with one or more other methine groups or with an auxochrome, $s_1$, $s_2$, $s_3$, $s_4$, and $s_5$ are independently equal to 0 or 1, X is an electric charge neutralizing counterion, and $k_1$ is an integer inclusive of 0 necessary to neutralize an electric charge in the molecule.

4. The heat-bleachable antihalation composition of claim 1 wherein said infrared radiation-absorbing compound is represented by the following Structure IV:

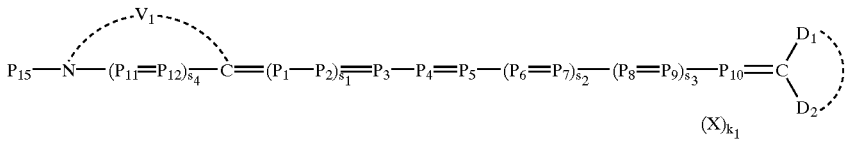

(IV)

wherein $D_1$ and $D_2$ represent the atoms necessary to form acidic acyclic, carbocyclic, or heterocyclic nuclei, $V_1$ represents the non-metallic necessary to form a 5-, 6-, or 7-membered heterocyclic ring, which ring may be further fused to additional carbocyclic or heterocyclic rings, $P_1$, $P_2$, $P_3$, $P_4$, $P_5$, $P_6$, $P_7$, $P_8$, $P_9$, $P_{10}$, $P_{11}$, and $P_{12}$ independently represent methine groups or substituted methine groups that optionally may form a ring with one or more other methine groups or with an auxochrome, $P_{15}$ represents an alkyl, aryl, alkaryl, or heterocycl group, $s_1$, $s_2$, $s_3$, and $s_4$, are independently equal to 0 or 1, X is an electric charge neutralizing counterion, and $k_1$ is an integer inclusive of 0 necessary to neutralize an electric charge in the molecule.

5. The heat-bleachable antihalation composition of claim 1 wherein said infrared radiation-absorbing compound is represented by the following Structure V:

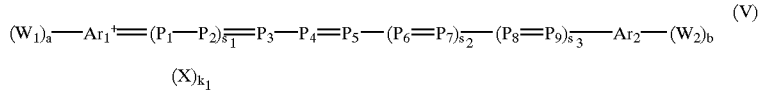

(V)

wherein $Ar_1$ and $Ar_2$ independently represent aromatic groups, $W_1$ and $W_2$ independently represent electron-donating substituent groups, "a" and "b" independently represent integers from 0 to 5, $P_1$, $P_2$, $P_3$, $P_4$, $P_5$, $P_6$, $P_7$, $P_8$, and $P_9$ independently represent methine groups or a substituted methine groups that optionally may form a ring with one or more other methine groups or with an auxochrome, $s_1$, $s_2$, and $s_3$, are independently equal to 0 or 1, X is an electric charge neutralizing counterion, and $k_1$ is an integer inclusive of 0 necessary to neutralize an electric charge in the molecule.

6. The heat-bleachable antihalation composition of claim 1 wherein said infrared radiation-absorbing compound is represented by the following Structure VI:

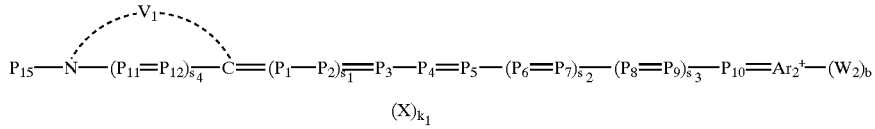

(VI)

wherein $V_1$ represents the non-metallic necessary to form a 5-, 6-, or 7-membered heterocyclic ring, which ring may be further fused to additional carbocyclic or heterocyclic rings, $P_1$, $P_2$, $P_3$, $P_4$, $P_5$, $P_6$, $P_7$, $P_8$, $P_9$, $P_{10}$, $P_{11}$, and $P_{12}$, independently represent methine groups or substituted methine groups that optionally may form a ring with one or more other methine groups or with an auxochrome, $P_{15}$ represents an alkyl, aryl, alkaryl, or heterocycl group, $s_1$, $s_2$, $s_3$, and $s_4$, are independently equal to 0 or 1, $Ar_2$ represents an aromatic group, $W_2$ represents an electron-donating substituent group, "b" represents an integer from 0 to 5, X is an electric charge neutralizing counterion, and $k_1$ is an integer inclusive of 0 necessary to neutralize an electric charge in the molecule.

7. The heat-bleachable antihalation composition of claim 1 wherein said infrared radiation-absorbing compound is represented by the following Structure VII:

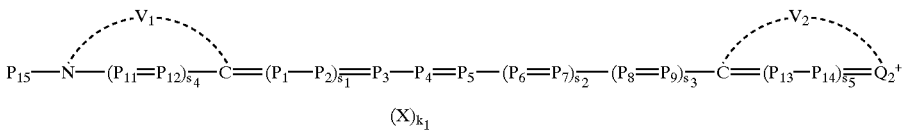

(VII)

wherein $V_1$ and $V_2$ independently represent groups of atoms necessary to form 5-, 6-, or 7-membered heterocyclic rings, which rings may be further fused to additional carbocyclic or heterocyclic rings, $P_1$, $P_2$, $P_3$, $P_4$, $P_5$, $P_6$, $P_7$, $P_8$, $P_9$, $P_{11}$, $P_{12}$, $P_{13}$, and $P_{14}$, independently represent methine groups or substituted methine groups that optionally may form a ring with one or more other methine groups or with an auxochrome, $P_{15}$ represents an alkyl, aryl, alkaryl, or heterocycl group, $s_1$, $s_2$, $s_3$, $s_4$, and $s_5$ are independently equal to 0 or 1, $Q_2$ represents a heteroatom, X is an electric charge neutralizing counterion, and $k_1$ is an integer inclusive of 0 necessary to neutralize an electric charge in the molecule.

8. The heat-bleachable antihalation composition of claim 1 wherein said infrared radiation-absorbing compound is represented by the following Structure VIII:

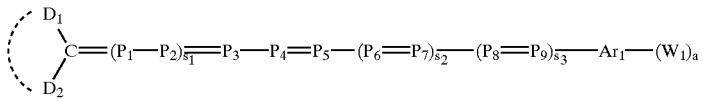

(VIII)

wherein $D_1$ and $D_2$ independently represent the atoms necessary to form acidic acyclic, carbocyclic, or heterocyclic nuclei, $Ar_1$ represents an aromatic group, $W_1$ represents an electron-donating substituent group, "a" represents an integer from 0 to 5, $P_1$, $P_2$, $P_3$, $P_4$, $P_5$, $P_6$, $P_7$, $P_8$, and $P_9$ independently represent methine groups or substituted methine groups that optionally may form a ring with one or more other methine groups or with an auxochrome, $s_1$, $s_2$, and $s_3$, are each independently equal to 0 or 1, X is an electric charge neutralizing counterion, and $k_1$ is an integer inclusive of 0 necessary to neutralize an electric charge in the molecule.

9. The heat-bleachable antihalation composition of claim 1 wherein said infrared radiation-absorbing compound is represented by the following Structure IX:

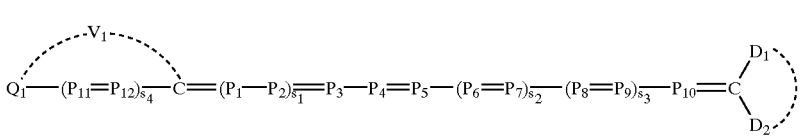

(IX)

wherein $D_1$ and $D_2$ independently represent the atoms necessary to form acidic acyclic, carbocyclic, or heterocyclic nuclei, $W_1$ represents an electron-donating substituent group, "a" represents an integer from 0 to 5, $P_1$, $P_2$, $P_3$, $P_4$, $P_5$, $P_6$, $P_7$, $P_8$, $P_9$, $P_{10}$, $P_{11}$ and $P_{12}$ independently represent methine groups or substituted methine groups that optionally may form a ring with one or more other methine groups or with an auxochrome, $s_1$, $s_2$, $s_3$, and $s_4$, are each independently equal to 0 or 1, $V_1$ represents the non-metallic necessary to form a 5-, 6-, or 7-membered heterocyclic ring, which ring may be further fused to additional carbocyclic or heterocyclic rings, $Q_1$ represents a heteroatom, X is an electric charge neutralizing counterion, and $k_1$ is an integer inclusive of 0 necessary to neutralize an electric charge in the molecule.

10. The heat-bleachable antihalation composition of claim 1 wherein said infrared radiation-absorbing compound is represented by the following Structure X:-

(X)

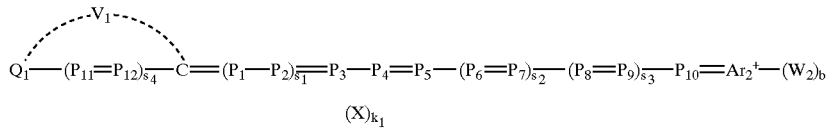

wherein $V_1$ represents the non-metallic necessary to form a 5-, 6-, or 7-membered heterocyclic ring, which ring may be further fused to additional carbocyclic or heterocyclic rings, $Q_1$ represents a heteroatom, Arrepresents an aromatic group, $W_2$ represents an electron-donating substituent group, "b" represents an integer from 0 to 5, $P_1$, $P_2$, $P_3$, $P_4$, $P_5$, $P_6$, $P_7$, $P_8$, $P_9$, $P_{10}$, $P_{11}$, and $P_{12}$ independently represent methine groups or substituted methine groups that optionally may form a ring with one or more other methine groups or with an auxochrome, $s_1$, $s_2$, $s_3$, and $s_3$, are independently equal to 0 or 1, X is an electric charge neutralizing counterion, and $k_1$ is an integer inclusive of 0 necessary to neutralize an electric charge in the molecule.

11. The heat-bleachable antihalation composition of claim 1 wherein said infrared radiation absorbing compound has a $\lambda_{max}$ of at least 700 nm.

12. The heat-bleachable antihalation composition of claim 1 wherein the molar ratio of said hexaarylbiimidazle to said infrared radiation absorbing compound is from about 1:1 to about 100:1.

13. The heat-bleachable antihalation composition of claim 1 wherein said infrared radiation absorbing compound is present in an amount of at least 0.01 weight %.

14. The heat-bleachable antihalation composition of claim 1 further comprising:

c) a film-for ring, organic solvent-soluble binder, and/or d) a polar organic solvent.

15. The heat-bleachable antihalation composition of claim 14 wherein said film-forming, organic solvent-soluble binder is a polystyrene or styrene derivative polymer, polyacrylate or polymethacrylate, polycarbonate, cellulose ester, polysulfonamide, polyvinyl halide, polyvinylidene halide, polyvinyl acetate, polyvinyl acetal, butadiene polymer, polyester, ethylene-vinyl acetate copolymer, or polyvinyl butyral.

16. The heat-bleachable antihalation composition of claim 14 wherein said organic solvent is methyl ethyl ketone, acetone, methanol, ethanol, methyl isobutyl ketone, cyclohexanone, toluene, or mixtures thereof.

17. The heat-bleachable antihalation composition of claim 1 wherein said hexaarylbiimidazole is represented by the following Structure XI:

(XI)

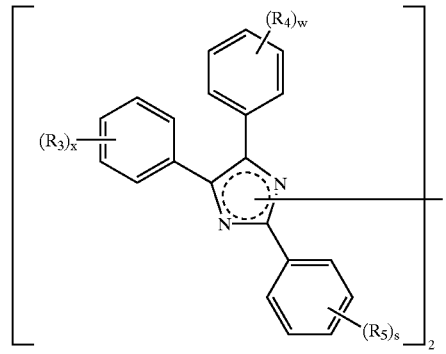

wherein $R_3$, $R_4$, and $R_5$ are independently alkyl, cycloalkyl, aryl, alkoxy, aryloxy, thioalkyl, thioaryl, non-aromatic heterocyclyl, alkylthio, arylthio, cyano, sulfonamido, benzoyl, carbonyloxy, carbonylamido, or halo groups, and w, x, and s are independently 0, 1, 2, 3, 4, or 5.

18. The heat-bleachable antihalation composition of claim 17 wherein each of $R_3$, $R_4$, and $R_5$ is in the meta or para position on the respective phenyl rings.

19. The heat-bleachable antihalation composition of claim 17 wherein $R_3$, $R_4$, and $R_5$ are in the meta or para position on the respective phenyl rings, and are independently alkyl, alkoxy, aryl, aryloxy, thioalkyl, thioaryl, or halo groups, and one or two of w, x, and s are independently 1 or 2.

20. The heat-bleachable antihalation composition of claim 19 wherein $R_3$, $R_4$, and $R_5$ are independently alkyl, alkoxy, or alkylthio groups.

21. The heat-bleachable antihalation composition of claim 15 wherein $R_3$, $R_4$, and $R_5$ are independently isopropyl, methoxy, or thiomethyl groups.

22. The heat-bleachable antihalation composition of claim 1 further comprising one or more non-heat-bleachable antihalation dyes.

23. A photothermographic material that is sensitive at a wavelength of at least 700 nm and comprises a support having thereon one or more thermally-developable imaging layers comprising a hydrophobic binder and in reactive association, a photosensitive silver halide, a non-photosensitive source of reducible silver ions, and a reducing composition for said non-photosensitive source reducible silver ions, and on the backside of said support, an antihalation layer comprising a heat-bleachable antihalation composition comprising:

a) a hexaarylbiimidazole, and b) an infrared radiation-absorbing compound having the following Structure I:

$$A_1—L_1—A_2 \quad (I)$$

wherein $A_1$ represents a group derived from a dye base, a heterocyclic group, or an electron-donating aromatic group, $A_2$ represents a group derived from a dye base, a heterocyclic group, a group derived from a dye acid, or an electron-donating aromatic group, and $L_1$ represents a conjugated linking group that maintains electron delocalization between $A_1$ and $A_2$ to provide infrared absorbance.

24. The photothermographic material of claim 23 wherein said non-photosensitive source of reducible silver ions is a silver fatty acid carboxylate having 10 to 30 carbon atoms in the fatty acid or a mixture of said silver carboxylates.

25. The photothermographic material of claim 23 wherein said reducing composition comprises at least one hindered phenol.

26. The photothermographic material of claim 23 further comprising a high contrast co-developing agent.

27. The photothermographic material of claim 23 that is sensitive to radiation of from about 700 to about 850 nm.

28. The photothermographic material of claim 23 wherein said hexaarylbiimidazole is present in said antihalation layer in an amount of at least $5\times10^{-7}$ mol/m$^2$.

29. The photothermographic material of claim 23 wherein said infrared radiation absorbing compound is present in said antihalation layer in an amount of at least $5\times10^{-7}$ mole/m$^2$, and the molar ratio of said hexaarylbiimidazole to said infrared radiation absorbing compound is from about 1:1 to about 100:1.

30. The photothermographic material of claim 23 wherein said infrared radiation-absorbing compound is one or more of:

a) a compound that is represented by the following Structure II;

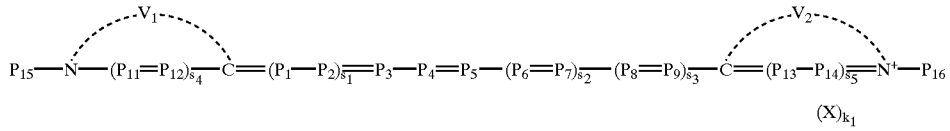

(II)

wherein $V_1$ and $V_2$ independently represent groups of atoms necessary to form 5-, 6-, or 7-membered heterocyclic rings, which rings may be further fused to additional carbocyclic or heterocyclic rings, $P_1$, $P_2$, $P_3$, $P_4$, $P_5$, $P_6$, $P_7$, $P_8$, $P_9$, $P_{11}$, $P_{12}$, $P_{13}$, and $P_{14}$ independently represent methine groups or substituted methine groups that optionally may form a ring with one or more other methine groups or with an auxochrome, $P_{15}$ and $P_{16}$ are independently alkyl, aryl, alkaryl, or heterocycl groups, $s_1$, $s_2$, $s_3$, $s_4$, and $s_5$ are independently equal to 0 or 1, X is an electric charge neutralizing counterion, and $k_1$ is an integer inclusive of 0 necessary to neutralize an electric charge in the molecule, b) a compound that is represented by the following Structure III:

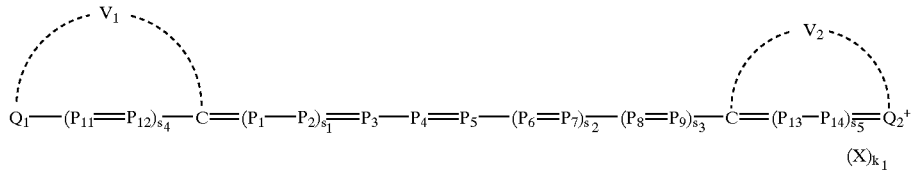

(III)

wherein $P_{10}$ represents a methine group or a substituted methine group that optionally may form a ring with one or more other methine groups or a ring with an auxochrome, $D_1$ wherein $Q_1$ and $Q_2$ independently represent heteroatoms, and $V_1$, $V_2$, $P_1$, $P_2$, $P_3$, $P_4$, $P_5$, $P_6$, $P_7$, $P_8$, $P_9$, $P_{11}$, $P_{12}$, $P_{13}$, $P_{14}$, $s_1$, $s_2$, $s_3$, $s_4$, $s_5$, X, and $k_1$ are described above, c) a compound that is represented by the following Structure IV:

(IV)

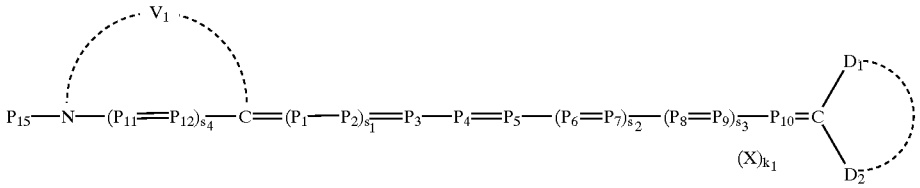

and $D_2$ independently represent the atoms necessary to form acidic acyclic, carbocyclic, or heterocyclic nuclei, and $V_1$, $P_1$, $P_2$, $P_3$, $P_4$, $P_5$, $P_6$, $P_7$, $P_8$, $P_9$, $P_{11}$, $P_{12}$, $P_{15}$, $s_1$, $s_2$ $s_3$, $s_4$, X, and $k_1$ are as described above, d) a compound that is represented by the following Structure V:

(V)

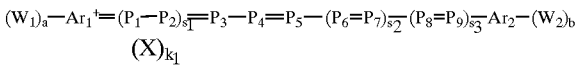

wherein $Ar_1$ and $Ar_2$ independently represent aromatic groups, $W_1$ and $W_2$ independently represent electron-donating substituent groups, "a" and "b" independently represent integers from 0 to 5, and $P_1$, $P_2$, $P_3$, $P_4$, $P_5$, $P_6$, $P_7$, $P_8$, $P_9$, $s_1$, $s_2$, $s_3$ X, and $k_1$ are as described above, e) a compound that is represented by the following Structure VI:

(VI)

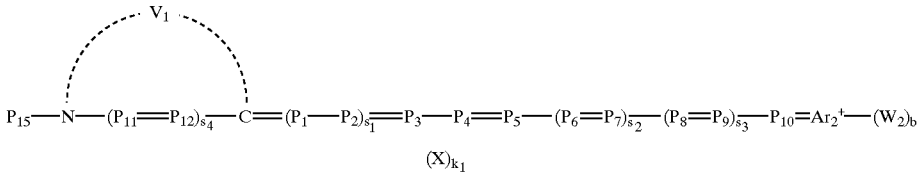

wherein $V_1$, $P_1$, $P_2$, $P_3$, $P_4$, $P_5$, $P_6$, $P_7$, $P_8$, $P_9$, $P_{10}$, $P_{11}$, $P_{12}$, $P_{15}$, $s_1$, $s_2$, $s_3$, $s_4$, $Ar_2$, $W_2$, "b", X, and $k_1$ are as described above, f) a compound that is represented by the following Structure VII:

(VII)

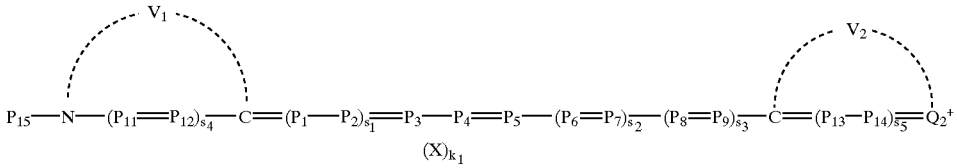

wherein $V_1$, $V_2$, $P_1$, $P_2$, $P_3$, $P_4$, $P_5$, $P_6$, $P_7$, $P_8$, $P_9$, $P_{11}$, $P_{12}$, $P_{13}$, $P_{14}$, $P_{15}$, $s_1$, $s_2$, $s_3$, $s_4$, $s_5$, $Q_2$, X, and $k_1$ are as described above, g) a compound that is represented by the following Structure VIII:

(VIII)

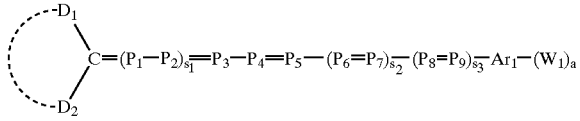

wherein $D_1$, $D_2$, $P_1$, $P_2$, $P_3$, $P_4$, $P_5$, $P_6$, $P_7$, $P_8$, $P_9$, $s_1$, $s_2$, $s_3$, $Ar_1$, $W_1$, and "a" are as described above, h) a compound that is represented by the following Structure IX:

(IX)

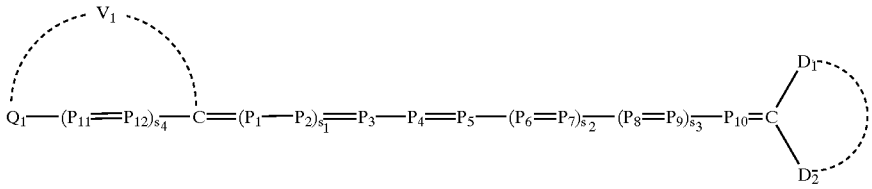

wherein $D_1$, $D_2$, $P_1$, $P_2$, $P_3$, $P_4$, $P_5$, $P_6$, $P_7$, $P_8$, $P_9$, $P_{10}$, $P_{11}$, $P_{12}$, $s_1$, $s_2$, $s_3$, $s_4$, $Q_1$, and $V_1$ are as described above, and i) a compound that is represented by the following Structure X:

(X)

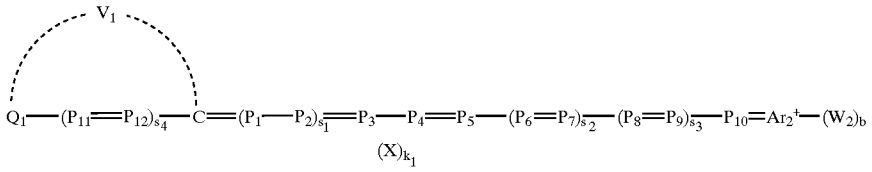

wherein $V_1$, $Q_1$, $P_1$, $P_2$, $P_3$, $P_4$, $P_5$, $P_6$, $P_7$, $P_8$, $P_9$, $P_{10}$, $P_{11}$, $P_{12}$, $s_1$, $s_2$, $s_3$,$s_4$, $Ar_2$, $W_2$, "b", X and $k_1$ are as described above.

31. A method of forming a visible image comprising:

A) imagewise exposing the photothermographic material of claim 23 to electromagnetic radiation at a wavelength of at least 700 nm to form a latent image, B) simultaneously or sequentially, heating said exposed photothermographic material to develop said latent image into a visible image.

32. The method of claim 31 wherein said photothermographic material comprises a transparent support, and said image-forming method further comprising:

C) positioning said exposed and heat-developed photothermographic material between a source of imaging radiation and an imageable material that is sensitive to said imaging radiation, and p1 D) exposing said imageable material to said imaging radiation through the visible image in said exposed and heat-developed photothermographic material to provide an image in said imageable material.

* * * * *

UNITED STATES PATENT AND TRADEMARK OFFICE

CERTIFICATE OF CORRECTION

PATENT NO. : 6,514,677 B1
DATED : February 4, 2003
INVENTOR(S) : William D. Ramsden et al.

It is certified that error appears in the above-identified patent and that said Letters Patent is hereby corrected as shown below:

Column 69,
Line 16, delete "Arrepresents" and substitute -- $Ar_2$ represents --
Line 49, delete "for ring" and substitute -- forming --

Column 76,
Line 35, delete "p1" and insert new paragraph D)

Signed and Sealed this

Twelfth Day of August, 2003

JAMES E. ROGAN
*Director of the United States Patent and Trademark Office*